US005692526A

United States Patent [19]

Adams et al.

[11] Patent Number: 5,692,526

[45] Date of Patent: Dec. 2, 1997

[54] CIGARETTE FOR ELECTRICAL SMOKING SYSTEM

[75] Inventors: John M. Adams, Mehanicsville; Mary Ellen Counts, Richmond; Grier S. Fleischhauer, Midlothian; Kenneth S. Houghton; Willie G. Houck, Jr., both of Richmond; Billy J. Keen, Jr., Chesterfield; Wesley G. Sanderson, Richmond; Susan E. Wrenn, Chesterfield, all of Va.

[73] Assignee: Philip Morris Incorporated, New York, N.Y.

[21] Appl. No.: 485,176

[22] Filed: Jun. 7, 1995

Related U.S. Application Data

[63] Continuation-in-part of Ser. No. 380,718, Jan. 30, 1995, which is a continuation of Ser. No. 118,665, Sep. 10, 1993, Pat. No. 5,388,594, which is a continuation-in-part of Ser. No. 943,504, Sep. 11, 1992, Pat. No. 5,505,214.

[51] Int. Cl.[6] ..... A24D 1/04

[52] U.S. Cl. ..... 131/194; 131/274; 131/335; 131/365

[58] Field of Search ..... 131/194, 335, 131/365, 274

[56] References Cited

U.S. PATENT DOCUMENTS

| | | | |
|---|---|---|---|
| 3,095,343 | 6/1963 | Berger . | |
| 3,515,146 | 6/1970 | Nealis | 131/335 X |
| 3,599,646 | 8/1971 | Berger et al. . | |
| 3,637,447 | 1/1972 | Berger et al. . | |
| 3,847,064 | 11/1974 | Berger . | |
| 3,865,121 | 2/1975 | Molins et al. . | |
| 4,022,221 | 5/1977 | Berger . | |
| 4,046,063 | 9/1977 | Berger . | |
| 4,075,936 | 2/1978 | Berger . | |
| 4,219,031 | 8/1980 | Rainer et al. . | |
| 4,505,282 | 3/1985 | Cogbill et al. | 131/365 X |
| 4,510,950 | 4/1985 | Keritsis et al. . | |
| 4,625,737 | 12/1986 | Keritsis et al. . | |
| 4,632,131 | 12/1986 | Burnett et al. . | |
| 4,784,632 | 11/1988 | Berger . | |
| 4,795,411 | 1/1989 | Fleischhauer et al. . | |
| 4,874,000 | 10/1989 | Tamol et al. . | |
| 4,941,486 | 7/1990 | Dube et al. | 131/365 |
| 4,984,589 | 1/1991 | Riedesser | 131/365 |
| 4,989,620 | 2/1991 | Keritsis et al. . | |
| 5,012,829 | 5/1991 | Thesing et al. . | |
| 5,024,241 | 6/1991 | Hulsman et al. | 131/365 X |
| 5,115,823 | 5/1992 | Keritsis . | |
| 5,178,166 | 1/1993 | Newsome et al. . | |
| 5,220,930 | 6/1993 | Gentry | 131/365 |
| 5,271,419 | 12/1993 | Arzonico et al. | 131/365 |
| 5,327,916 | 7/1994 | Jones et al. | 131/365 X |

FOREIGN PATENT DOCUMENTS 0 244 272 A2 4/1987 European Pat. Off. .

*Primary Examiner*—V. Millin

*Attorney, Agent, or Firm*—Charles E. B. Glenn; James E. Schardt; James T. Moore

[57] ABSTRACT

A novel cigarette of an electrical cigarette system and method of making same, the cigarette comprising a tubular tobacco web and a plug disposed within said tubular tobacco web which provides a structural connection that remains intact after a smoking of the cigarette. The disclosure includes a double-belled plug extending between a free end and a tipped end of a tobacco rod, or in the alternative, a column of tobacco with higher and lower density segments. The disclosure includes a method comprising the steps of producing a continuous plug, passing same through a die, overwrapping the rod with tobacco mat and overwrap, and severing the rod.

41 Claims, 17 Drawing Sheets

CIGARETTE FOR ELECTRICAL SMOKING SYSTEM

CROSS REFERENCE TO RELATED APPLICATIONS

The present application is a continuation-in-part of commonly assigned, patent application Ser. No. 08/380,718, which was filed Jan. 30, 1995, as a continuation of application Ser. No. 08/118,665, filed Sep. 10, 1993 pending, which in turn is a continuation-in-part of commonly assigned patent application Ser. No. 07/943,504, filed Sep. 11, 1992 now U.S. Pat. No. 5,505,214. Ser. No. 08/118,665 issued as U.S. Pat. No. 5,388,594 on Feb. 14, 1995. The present application relates to commonly assigned patent application Ser. No. 07/943,747, filed Sep. 11, 1993 now U.S. Pat. No. 5,369,723 and to commonly assigned U.S. Pat. No. 5,060,671, issued Oct. 29, 1991; U.S. Pat. No. 5,095,921, issued Mar. 17, 1992; and U.S. Pat. No. 5,224,498, issued Jul. 6, 1992; all which are hereby incorporated by reference.

BACKGROUND OF THE INVENTION

1. Field Of the Invention

The present invention relates generally to electrical smoking systems, and in particular cigarettes adapted to cooperate with electrical lighters of electrical smoking systems, and methods of making the cigarettes.

2. Discussion of the Related Art

Traditional cigarettes deliver flavor and aroma to the smoker as a result of combustion. During combustion of a cigarette, a mass of combustible material (tobacco) is oxidized at temperatures which can exceed 800° C. during puffing. The combustion process and the heat produced thereby releases various gaseous combustion products and distillates. As these gaseous products are drawn through the cigarette, they cool and condense to form an aerosol or vapor which provides the tastes and aromas associated with smoking.

Traditional cigarettes are known to produce sidestream smoke during smoldering. Also, once lit, they must be fully consumed or be discarded. Re-lighting a conventional cigarette is possible but is usually an unattractive prospect for subjective reasons (flavor, taste, odor) to a discerning smoker.

A prior alternative to the more traditional cigarettes includes those in which the combustible material itself does not directly provide the flavorants to the aerosol inhaled by the smoker. In these smoking articles, a combustible heating element, typically carbonaceous in nature, is combusted to heat air that is drawn over the heating element and through a zone which contains heat-activated activated elements that release a tobacco aerosol. While this type of smoking device produces little or no sidestream smoke, it still generates products of combustion and, once lit, it is not adapted to being snuffed for future use in a conventional sense.

Commonly assigned, U.S. patent applications Ser. No. 08/118,665, filed Sep. 10, 1993 (PM 1697) and Ser. No. 07/943,504, filed Sep. 11, 1992 (PM 1550) disclose various heating elements and flavor generating articles which significantly reduce sidestream smoke while permitting the smoker to selectively suspend and reinitiate smoking. However, the cigarette articles disclosed in these patents may collapse, tear or break when mishandled. In certain circumstances, these prior cigarette articles may crush as they are inserted into the electric lighters. Once they are smoked, they may tear or break as they are removed from the lighter.

The aforementioned, U.S. patent application Ser. No. 08/118,665 (PM 1697) describes an electrical smoking system including a novel electrically powered lighter and a novel cigarette that is adapted to cooperate with the lighter. The preferred embodiment of the lighter includes a plurality of metallic serpentine heaters disposed in a configuration that slidingly receives a tobacco rod portion of the cigarette.

The preferred embodiment of the cigarette in Ser. No. 08/118,665 (PM 1697) preferably comprises a tobacco-laden tubular carrier, a cigarette paper overwrapped about the tubular carrier, an arrangement of flow-through filter plugs at a mouthpiece end of the carrier and a filter plug at the opposite (distal) end of the carrier. The preferred embodiment is shown as being hollow between the filter plugs at the mouthpiece end of the cigarette and the plug at the distal end. The cigarette and the lighter are configured such that when the cigarette is inserted into the lighter and as individual heaters are activated for each puff, localized charring occurs at spots about the cigarette in the locality where each heater was bearing against the cigarette. Once all the heaters have been activated, these charred spots are closely spaced from one another and encircle a central portion of the carrier portion of the cigarette. Depending on the maximum temperatures and total energies delivered at the heaters, the charred spots manifest more than mere discolorations of the cigarette paper. In most applications, the charring will create at least minute breaks in the cigarette paper and the underlying carrier material. Such breaks tend to mechanically weaken the cigarette. For the cigarette to be withdrawn from the lighter, the charred spots must be at least partially slid past the heaters. In aggravated circumstances, such as when the cigarette is wet or mishandled or twisted, the cigarette might break or leave pieces upon its withdrawal from the lighter. Pieces left in the lighter fixture can interfere with the proper operation of the lighter and/or deliver an off-taste to the smoke of the next cigarette. If the cigarette breaks in two while being withdrawn, the smoker may be faced not only with the frustration of a failed cigarette product, but also with the prospect of clearing debris from a clogged lighter before he or she can enjoy another cigarette.

The hollow structure of Ser. No. 08/118,668 (PM 1697) also is vulnerable to damage during cigarette making and packing, particularly in modern, high speed cigarette making and packing machines.

SUMMARY OF THE INVENTION

Accordingly, a primary object of the present invention is to provide a novel cigarette for use in electrical smoking systems which provide advantages over prior systems.

Another object of the present invention is to provide a cigarette adapted for use in electrical smoking systems without breakage during the withdrawal of the cigarette from the lighter thereof.

It is another object of the present invention to provide a cigarette suited for consumption with a lighter of an electrical smoking system wherein the cigarette itself is not vulnerable to collapse or breakage during handling by the consumer.

It is another object of the present invention to provide a cigarette suited for consumption with a lighter of an electrical smoking system wherein the cigarette itself is not vulnerable to collapse or breakage during the manufacture or packing of the cigarette.

It is still a further object of this invention to provide a cigarette and a method of making same that is cost effective, even at production speeds.

It is a still further object of the present invention to provide a physically more robust cigarette construction while minimizing and/or controlling condensation and/or filtration of aerosol within the cigarette.

It is also a further object to provide a more durable cigarette for electrical smoking systems, which includes an arrangement within the cigarette to add mechanical strength to the tobacco rod, yet not exacerbate condensation of aerosol within the cigarette.

Yet another object of the present invention is to provide a smoking article which is feasible to manufacture and pack into attractive packaging.

These objects and other advantages are provided by the present invention which provide a smoking system for delivering a flavored tobacco response to a smoker. The system includes a removable cigarette and a lighter, which lighter includes a plurality of electrical heaters that when activated provide a predetermined quantity of tobacco flavored aerosol from the cigarette.

In accordance with one aspect of the present invention, there is provided a cigarette comprising a tobacco rod portion and a filter-tip portion, wherein the tobacco rod portion preferably comprises a tubular carrier, a double-belled plug located within the carrier and cigarette paper wrapped about the carrier so as to provide the appearance and feel of a more conventional cigarette. The carrier web is preferably coated with tobacco material along its inner surface. Preferably, the double-belled plug has an hourglass-like shape defined by a central stem portion, a smooth belled portion located at one end the carrier and a fluted belled portion at the opposite end of the carrier. Preferably, the tipping of the cigarette includes a flow through plug, a mouthpiece filter plug and tipping paper attaching the plugs to the tobacco rod portion, with the fluted belled portion of the tobacco rod portion being located adjacent the tipping.

A space is enclosed within the carrier between the belled portions of the double belled plug. The plurality of flutes in the double belled plug communicates the aforementioned space with the flow path through the tipping portion of the cigarette. The smooth belled portion of the double belled plug serves to control the admission of air axially through the free end of tobacco rod.

When a cigarette of the present invention is inserted into a lighter of an electrical smoking system, the cigarette provides smoke responsively to puffing action upon the cigarette by a smoker. As a puff is initiated, at least one of the heaters of the lighter activates to heat the cigarette at a location along the tobacco rod in the vicinity of the stem. As the tobacco rod is heated, aerosol is driven off the tobacco material into the space defined between the stem and the tobacco carrier web which is then drawn through the flutes of the double-belled plug into the tipping of the cigarette. A desired proportion of air is drawn through the walls of the tobacco rod through minute breaks therein as a result of heating and/or through perforations. The smooth bell at the free end of the tobacco rod limits admission of air directly through the free end of the double belled plug. The stem and the flutes of the double-belled plug are configured to minimize impaction with the aerosol so as to avoid condensation thereat.

Another aspect of the present invention is provision for the efficient and continuous manufacture of a cigarette in accordance with the present invention, which includes the continuous formation of filter plug material, crimping same to form the stem and flutes therein and then wrapping the continuous, crimped filter plug in a tobacco-carrier web (preferably together with cigarette wrapper) and then cutting same to form individual and/or multiple tobacco rods. The process further includes tipping the formed tobacco rods at the fluted end.

The present invention includes additional embodiments wherein the tubular form of the tobacco carrier web is reinforced by the inclusions of cut filler within the confines of the tobacco carrier web.

BRIEF DESCRIPTION OF THE DRAWINGS

Other objects, advantages and novel features of the present invention will become apparent from the following Detailed Description of the preferred embodiments when considered in conjunction with the accompanying drawings, wherein.

DETAILED DESCRIPTION OF THE PREFERRED EMBODIMENTS

Figure 1A:
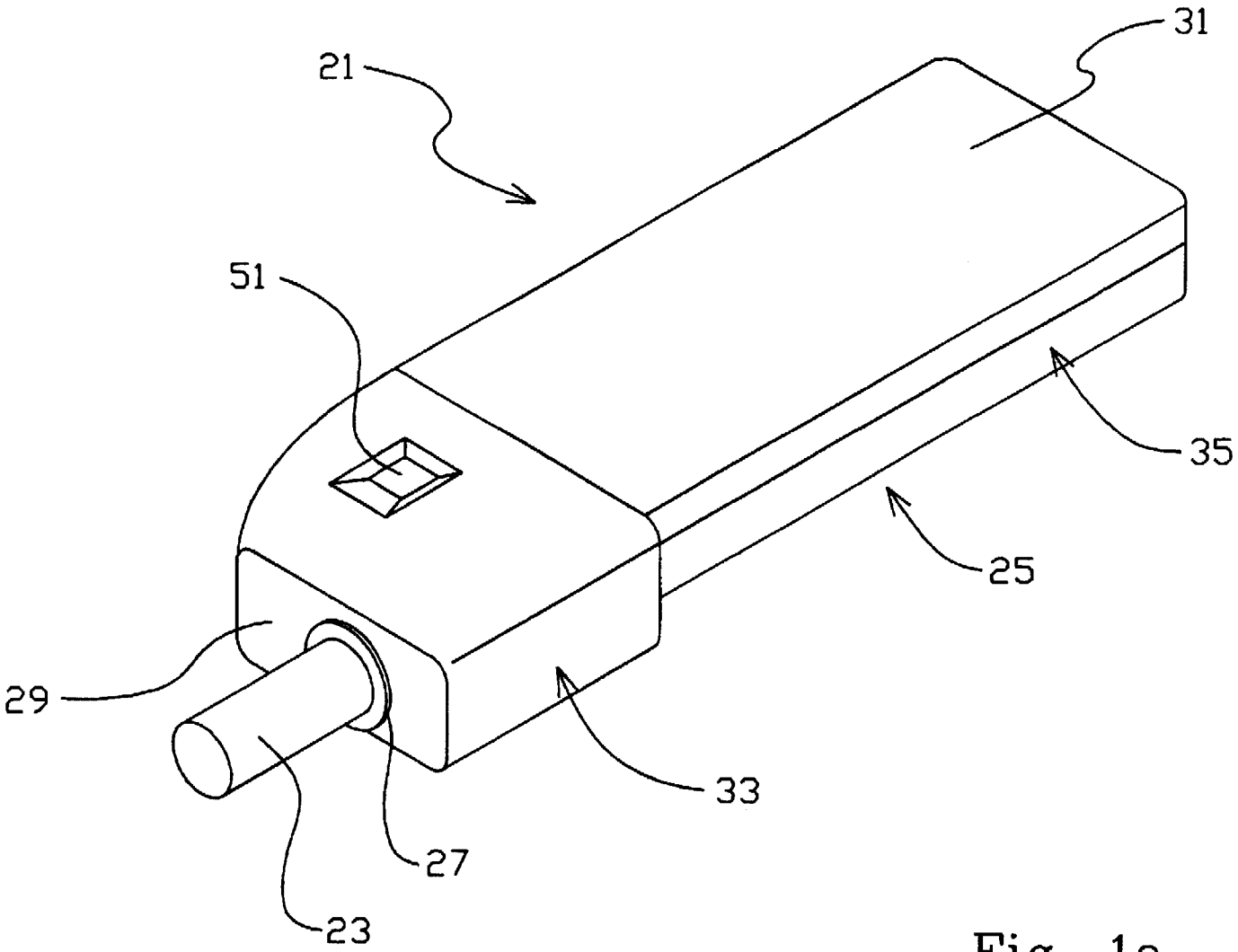
FIGS. 1*a* and 1*b* are perspective views of a smoking system in accordance with a preferred embodiment of the present invention.
Figure 1B:
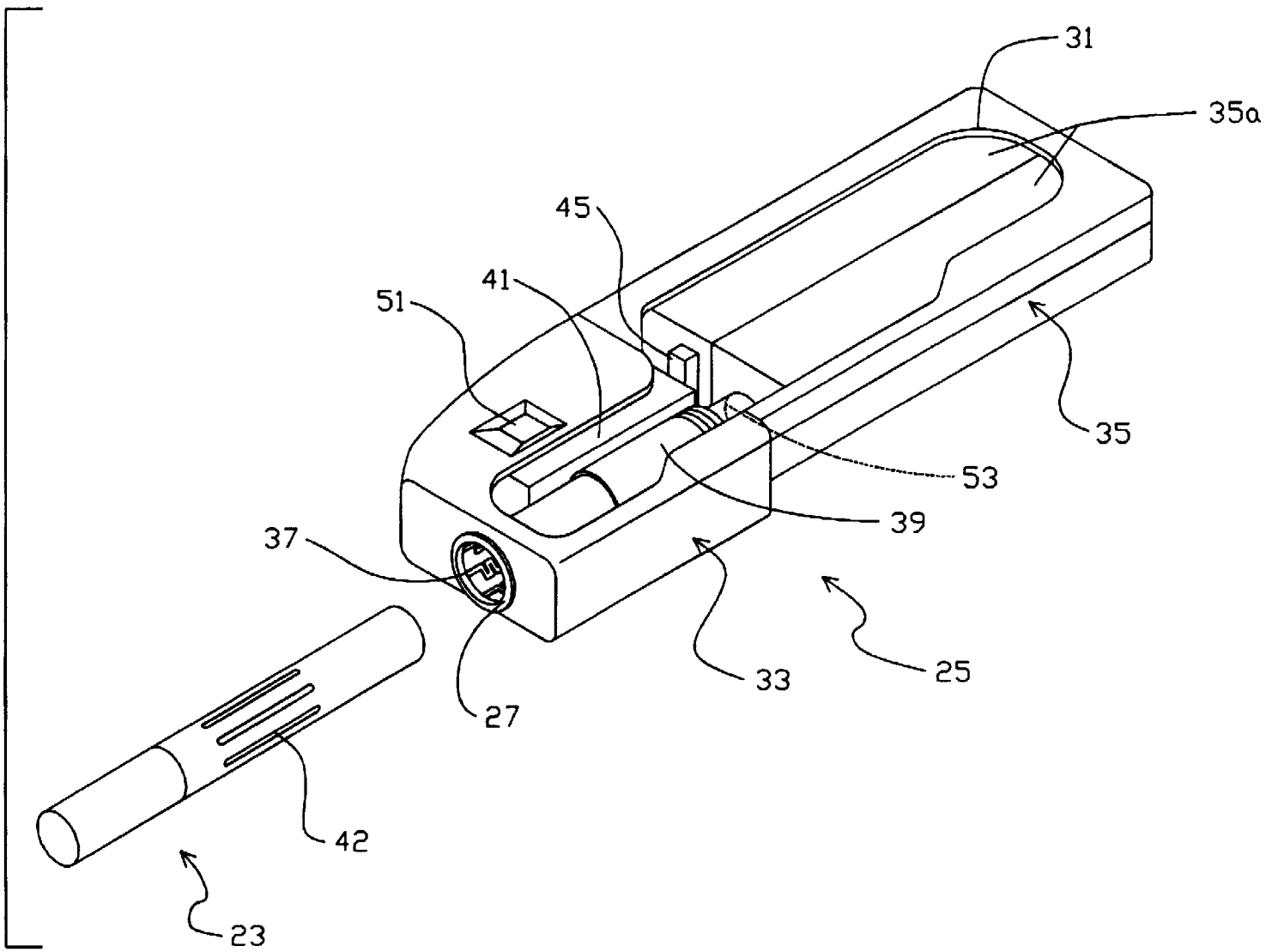

Referring to FIGS. 1*a* and 1*b*, a preferred embodiment of the present invention provides a smoking system 21 which includes a cigarette 23 and a reusable lighter 25. The cigarette 23 is adapted to be inserted in and removed from a receptacle 27 at a front end 29 of the lighter 25. Once the cigarette 23 is inserted, the smoking system 21 is used in much the same fashion as a more conventional cigarette. The cigarette 23 is discarded after one or more puff cycles. Preferably, each cigarette 23 provides a total of eight puffs (puff cycles) or more per smoke; however it is a matter design expedient to adjust to a lesser or greater total number of available puffs.

The lighter 25 includes a housing 31 and has front and rear housing portions 33 and 35. One or more batteries 35*a*, which are removably located in the rear housing portion 35, supply energy to a plurality of heating elements 37 which are arranged in the receptacle 27. Preferably, the rear portion 35 is adapted to be easily opened and closed, such as with screws or with snap-fit components, to facilitate replacement of the batteries.

The front housing portion 33 houses a number of electronic components, including the heating elements 37 and a control circuitry 41 which is in electrical communication between the power source (batteries 35*a*) in the rear portion housing 35 and the heaters 37 in the front housing portion 33. The front housing portion 33 is preferably easily joined to the rear housing portion 35, such as with a dovetail joint or by a socket fit. The housing 31 is preferably made from a hard, heat-resistant material. Preferred materials include metal-based or, more preferably, polymeric materials. Preferably, the housing 31 has overall dimensions of about 10.7 cm by 3.8 cm by 1.5 cm. so that it may fit comfortably in a hand of a smoker.

The batteries 35*a* are sized to provide sufficient power for the heaters 37 to function as intended and preferably comprise the replaceable and rechargeable type. Alternate sources of power are suitable, such as capacitors. In the preferred embodiment, the power source comprises four nickel-cadmium battery cells connected in series with a total, non-loaded voltage of approximately 4.8 to 5.6 volts. The characteristics required of the power source are, however, selected in view of the characteristics of other components in the smoking system 21, particularly the characteristics of the heating elements 37. U.S. Pat. No. 5,144,962 (PM 1345), hereby incorporated by reference, describes several types of power sources useful in connection with the smoking system of the present invention, such as rechargeable battery sources and power sources which include a which is recharged by a battery.

The front housing portion 33 of the lighter 25 includes a substantially cylindrical heater fixture 39 that defines the receptacle 27 which receives the cigarette 23. The heater fixture 39 houses the heater elements 37 and is adapted to support an inserted cigarette 23 in fixed relation to the heater elements 37. The front housing portion 33 of the lighter 25 also includes the electrical control circuitry 41 which delivers a predetermined amount of energy from the power source 37 to the heating elements 37. In the preferred embodiment, the heater fixture 39 includes eight circumferentially spaced-apart heating elements 37 which are arranged inside the receptacle 27 so as to slidingly receive the cigarette 23 upon insertion. Details of the heaters 37 are illustrated and described in commonly assigned U.S. Ser. No. 07/943,504 (PM 1550), copending herewith and in commonly assigned, U.S. Ser. No. 08/118,665 (PM 1697), copending herewith, both of which documents are incorporated herein by reference. Preferably, the heaters 37 are individually energized by the power source 37 under the control of the circuitry 41 to heat the cigarette 23 eight times at spaced locations about the periphery of the cigarette 23. The heating renders eight puffs from the cigarette 23, as is achieved with the smoking of a more traditional cigarette.

Referring specifically to FIG. 1*b*, the circuitry 41 is preferably activated by a puff-actuated sensor 45 that is sensitive either to pressure changes or air flow changes that occur when a smoker draws on the cigarette 23. The puff-actuated sensor 45 is preferably housed within the front housing portion 33 of the lighter 25 and communicates with a space inside the heater fixture 39 and near the cigarette 23 through a passageway extending through a spacer at the base of the heater fixture 39 and, if desired, a puff sensor tube (not shown). A puff-actuated sensor 45 suitable for use in the smoking system 21 is described in U.S. Pat. No. 5,060,671 (PM 1337), the disclosure of which is incorporated by reference. The puff sensor 45 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for activating an appropriate one of the heater elements 122 upon detection of a change in air flow. Once activated by the sensor 45, the control circuitry 41 directs electrical current to an appropriate one of the heater elements 37.

An indicator 51 is preferably provided at a location along the exterior of the lighter 25, preferably on the front housing portion 33, to indicate the number of puffs remaining on a cigarette 23 being smoked. The indicator 51 preferably includes a seven-segment liquid crystal display. In the preferred embodiment, the indicator 51 displays the digit "8" when a cigarette detector 53 detects the presence of a cigarette in the heater fixture 39. The detector 53 preferably comprises a light sensor at the base of the heater fixture 39 that detects when a beam of light is reflected off an inserted cigarette 23. Thereupon the cigarette detector 53 provides a signal to the circuitry 41 which, in turn, responsively provides a signal to the indicator 51. The display of the digit "8" on the indicator 51 reflects that the preferred eight puffs provided on each cigarette 23 are available, i.e., none of the heater elements 43 have been activated to heat a fresh cigarette 23. After the cigarette 23 is fully smoked, the indicator displays the digit "0". When the cigarette 23 is removed from the lighter 25, the cigarette detector 53 does not detect the presence of a cigarette 23 and the indicator 51 is turned off. The cigarette detector 53 is modulated so that it does not constantly emit a light beam, which would otherwise create an unnecessary drain on the power source 37. A preferred cigarette detector 53 suitable for use with the smoking system 21 is a Type OPR5005 Light Sensor, manufactured by OPTEX Technology, Inc., 1215 West Crosby Road, Carrollton, Tex. 75006.

In the alternative to displaying the remainder of the puff count, the detector display may be arranged instead to indicate whether the system active (simply is "on" or "off").

As one of several possible alternatives to using the above-noted cigarette detector 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry, puff-actuated sensors, and indicators useful with the smoking system 21 of the present invention are described in U.S. Pat. No. 5,060,671 (PM 1337) and the commonly assigned U.S. patent application Ser. No. 07/943,504, (PM 1550) both of which are incorporated by reference.

Figure 2:
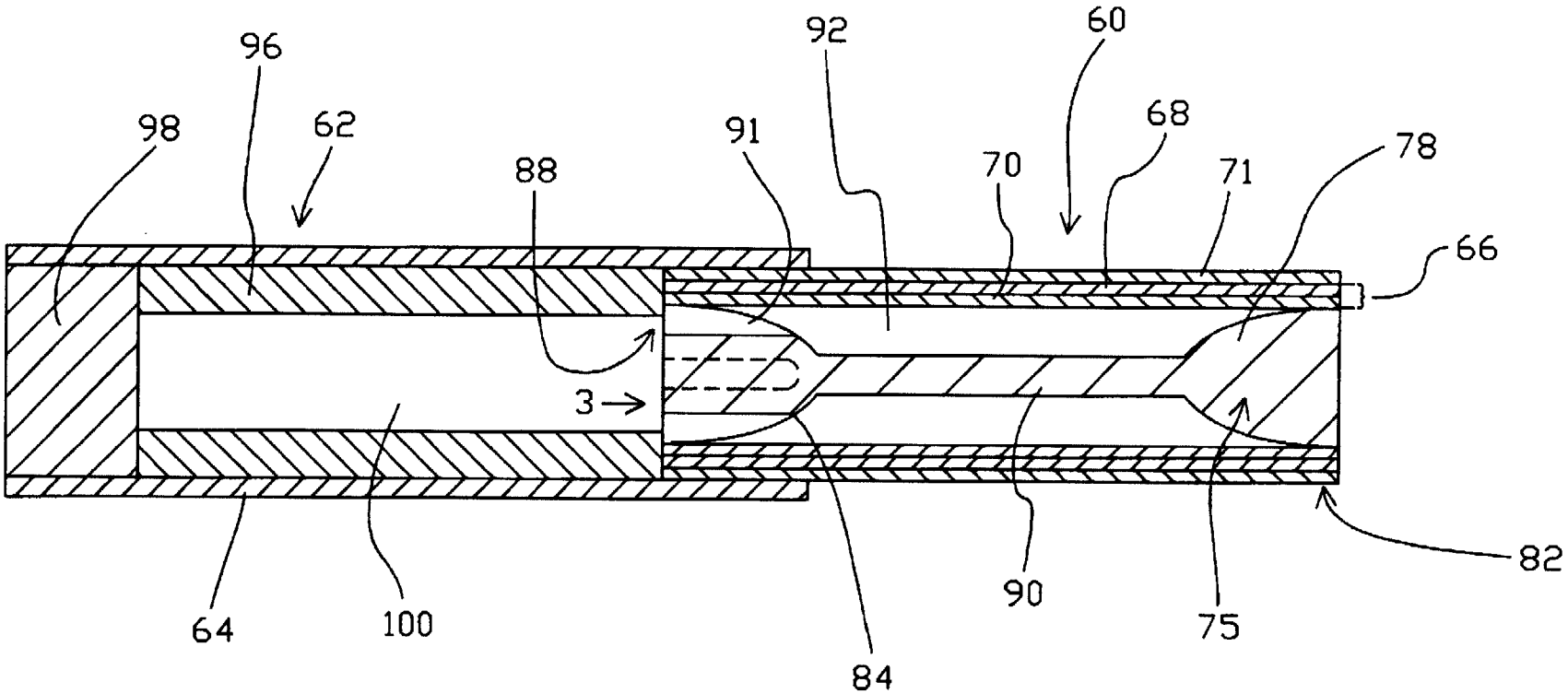
FIG. 2 is a cross-sectional view of a cigarette constructed in accordance with a preferred embodiment of the present invention.
Figure 4:
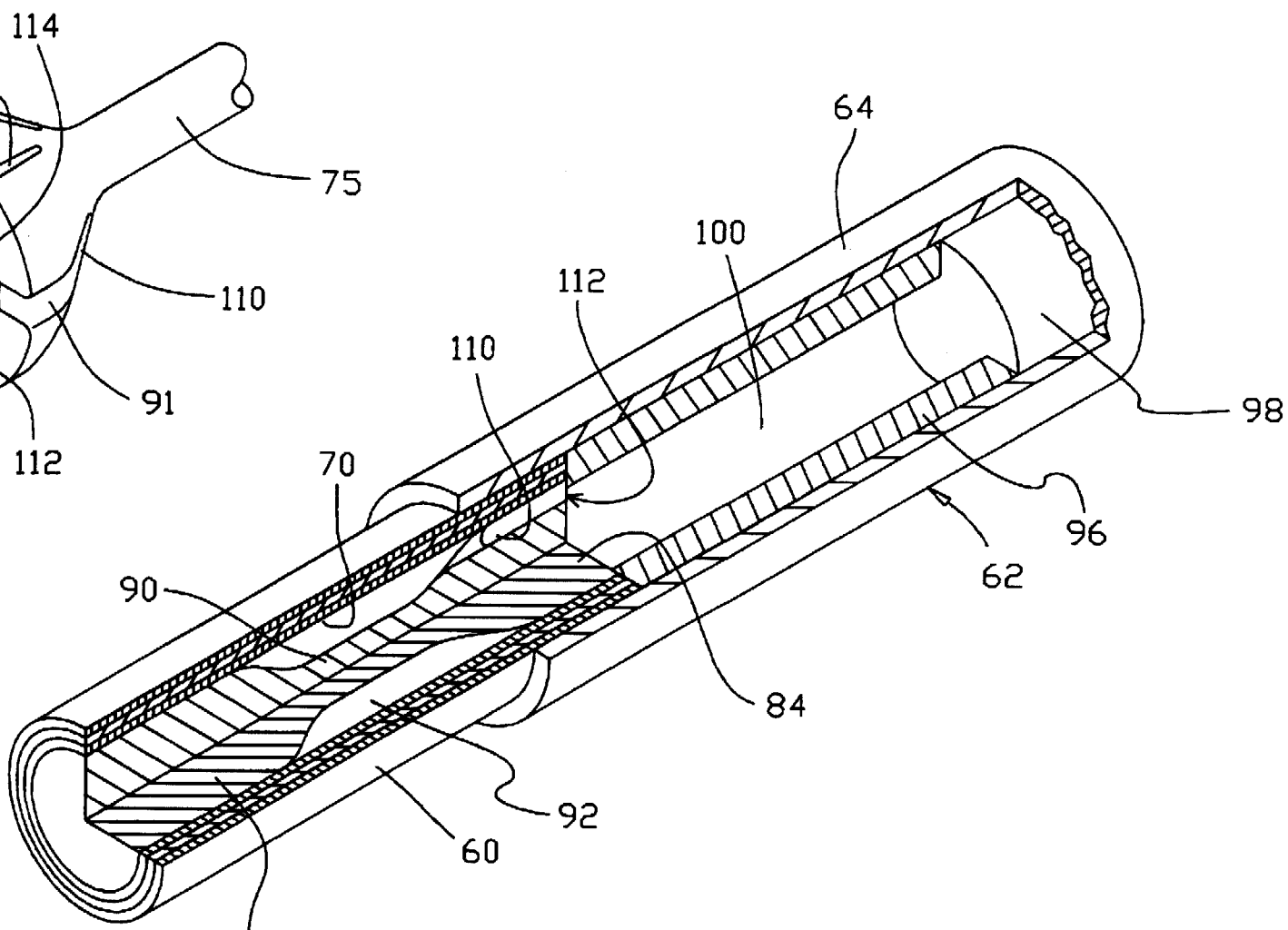
FIG. 4 is a sectional perspective view of the cigarette shown in FIG. 2.

Referring now to FIGS. 2 and 4, the cigarette 23 as constructed in accordance with the preferred embodiment of the present invention comprises a tobacco rod 60 and a filter tipping 62, which are held together preferably by a tipping paper 64.

The tobacco rod 60 of the cigarette 23 preferably includes a tobacco web 66 that has been folded into a tubular (cylindrical) form and wrapped in an overwrap 71. The overwrap 71 is preferably in the form of a low basis weight cigarette paper, preferably about 15 to 25 grams per meter squared basis weight and more preferably about 18 to 22 grams per meter squared basis weight, with a weight percent loading of about 5% or less calcium carbonate filler. Conventional cigarette overwrap papers with 25 to 30 g/m$^2$ basis weight and 20 to 35% calcium carbonate filler may also be used.

The tobacco web 66 preferably comprises a plenum base web 68 that carries a layer of tobacco flavor material 70. The tobacco web 66 is wrapped about and preferably glued at convenient locations to a double-belled plug 75. Preferably, the plug 75 has at one end a smooth bell 75 which is affixed to the tobacco web 66 at or about the free end 82 of the tobacco rod 60. A fluted bell 84 is provided at the opposite end of the double-belled plug 75 and is affixed to the tobacco web 66 at the tipped end 88 of the tobacco rod 60. The double-belled plug 75 further comprises a stem 90 extending between the smooth bell 78 and the fluted bell 84. The stem 90 extends concentrically through an intermediate portion of the tobacco web 66 The double-belled plug 75 provides a structural connection between the tipped end 88 of the tobacco rod 60 and its free end 82.

Figure 3A:
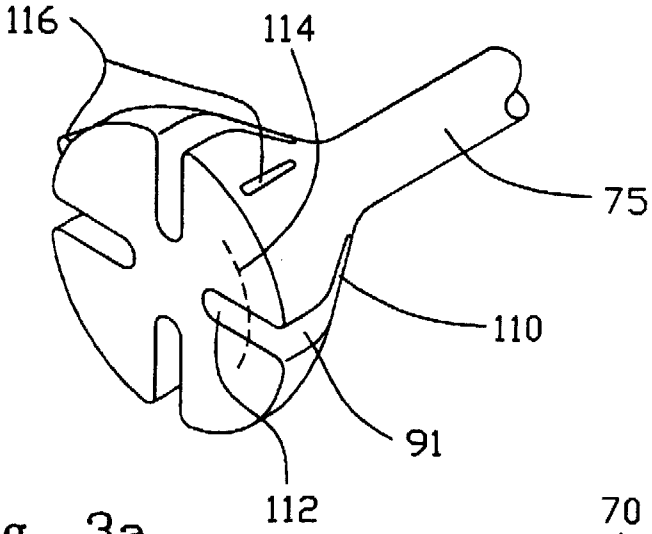
FIG. 3*a* is a detail perspective view of the fluted end of the double-belled plug, which view is taken from along line 3—3 in FIG. 2.

Referring now FIGS. 2 and 3A, the fluted bell 84 of the plug 75 includes a plurality of fluted passages or flutes 91. Each of the flutes 91 are configured to allow air in the space 92 enclosed by the tobacco web 66 to be withdrawn into the tipping 62.

Preferably, the double-belled plug 75 comprises plasticized tow formed into its generally hour-glass shape. Preferably, the surface of the belled plug 75 is made as smooth as possible along the entire length thereof, but particularly along the stem 90 and at or about flutes 91. Preferably, the choice of materials and/or the manufacturing techniques of the double-belled plug 75 renders it impervious to air or at least causes it to impart a relatively large pressure drop so that the smooth bell 78 substantially prevents or at least limits the amount of air admitted through the free end 82 of the tobacco rod 60.

In the alternative, however, the double-belled plug 75 may be constructed such that the belled portions 78 and 84 are air-transmissive. With such construction, air is drawn through the flutes 91 of the fluted bell 84 and to a lesser extent through the body of the fluted bell 84 itself.

In the preferred embodiment, the double-belled plug 75 is constructed from cellulose acetate tow of large denier (preferably in the range of 7 to 13 denier per filament (dpf) and more preferably about 8 dpf, but with a minimum number of filaments (preferably having a total denier of about 25,000 grams per 9,000 meter length).

The tipping 62 preferably comprises a free-flow filter 96 located adjacent the tobacco rod 60 and a mouthpiece filter plug 98 at the other end of the tipping 62. Preferably the free-flow filter 96 is tubular and transmits air with very little pressure drop. Other low efficiency filters could be used however. The preferred inside diameter for the space 100 within the free flow filter 96 is between 2–6 mm. The mouthpiece filter plug 98 closes off the free end of the tipping 62 for purposes of appearance and, if desired, effects some filtration, although it is preferred that the mouthpiece filter plug 98 comprise a low efficiency filter of preferably about 15 to 25 percent efficiency.

In the preferred embodiment, the inside radius of the hollow space 100 within the free flow filter 96 is smaller than the radius describing the inside surface of the tobacco web 66. The flutes 91 are configured to have a depth in the radially inward direction (with respect to the axis of symmetry of plug 75) sufficient to communicate the space 100 of the free flow filter 96 with the space 92 of the tobacco rod 60.

The mouthpiece filter plug 98, the free flow filter 96 and the tobacco rod 60 are joined together with the tipping paper 64. The tipping paper 64 is preferably of standard specifications as conventionally used throughout the cigarette industry.

Preferably, a cigarette overwrap paper 71 is wrapped around the tobacco web 60 so as to render external appearance and feel of a more traditional cigarette. Types of paper useful as the overwrap paper include conventional cigarette paper, a low basis weight paper, a paper with a tobacco coating, or a tobacco fiber based paper to enhance the tobacco flavor delivered to the smoker. A concentrated tobacco extract liquor in full or diluted strength may be (optionally) coated on the overwrap paper. The overwrap paper 71 preferably possesses a minimal basis weight and caliper while providing sufficient tensile strength for machine processing (cigarette making and packing) and handling by the consumer. The characteristics of the tobacco fiber-based paper include a basis weight (at 60% relative humidity) of between about 20–25 grams per meter squared (g/m2), a minimal permeability of 0–25 CORESTA, but more preferably at or about 10–15 CORESTA (defined as the amount of air, measured in cubic centimeters, that passes through one square centimeter of material, e.g., a paper sheet, in one minute at a pressure drop of 1.0 kilopascal), a tensile strength greater than or about 2000 grams/inch width (1 in/min), a caliper of approximately 1.3 to 2.0 mils (thousandths of an inch), and a calcium carbonate ($CaCO_3$) content of about or less than 5% by weight of the paper. Materials for forming the overwrap paper preferably include 50% or more of tobacco-based fiber (preferably non-cigar, flue-cured or flue/air-cured mixed filler and bright stem). Flax fiber in amounts no greater than that necessary to obtain adequate tensile strength may be added, preferably in the range of approximately 30 to 50%

In constructing an overwrap paper 71 which includes tobacco fibers, a binder such as citrus pectin or the like may be added in amounts less than or equal to 1% (by weight of the paper web) to effect surface properties for adhesion; however, pectin may be omitted in papers constructed from flax. Glycerin may be added to tobacco-based papers in amounts no greater than necessary to obtain paper stiffness at levels similar to those used in conventional cigarette papers.

The overwrap paper 71 can also comprise conventional flax fiber paper of a basis weight of about 15–20 g/m$^2$ or such flax cigarette paper with a tobacco extract coating.

During smoking of the cigarette 23 described with reference to FIG. 2, air is preferably first drawn radially inwardly (transversely) into the cigarette 23 predominantly through the tobacco web 66 and the overwrap paper 71 into the space 92 within the rod 60 along a transverse, radially inward path, and not so much through the free end 82 as in a more conventional cigarette. Admission of air in a longitudinal (axial) direction is limited by the smooth belled portion 78 of the double-belled plug 75 and/or by a partially or fully air-occlusive fit between the free end 82 of the cigarette 23 and the heater fixture 39 when the cigarette 23 is inserted into the lighter 25. Radial flow may be facilitated to a controlled degree by perforating the overwrap 71 or the tobacco web 66 or both.

It is presently understood that drawing air into the cigarette 23 longitudinally through the free end 82 tends to allow aerosol to collect about and condense onto the heater elements 37 of the lighter 25 during a smoke. Accordingly, the amount of air drawn longitudinally into the cigarette 23 during smoking is controlled and preferably minimized by the smooth bell 78 of the plug 75, except perhaps during the first puff. Additionally, the smooth bell 78 prevents aerosol from backflowing from within the rod 60 back through the free end 82 of the tobacco rod 60 into the lighter 25 at the conclusion or interruption of a puff.

The base web 68 separates the heating elements 37 from the tobacco flavor material, transfers heat generated by the heater elements to the flavor material 70, and maintains physical cohesion of the tobacco rod in cooperation with the double-belled plug 75 during handling, insertion into the lighter 25 and its removal therefrom after smoking.

Preferably, the tobacco web 66 is formed by using a paper making-type process to form the base web 68 while concurrently or thereafter applying the tobacco flavor material 70 onto the base web 68. In the first portion of this process, tobacco strip is washed with water and the solubles are collected for use in a later coating step. The remaining (extracted) tobacco fiber is used in the preparation of a slurry that will be used in web/paper forming techniques to form the base web 68. To strengthen the base web 68, carbon fibers may be added to the slurry by dispersing a stock of carbon fibers in water and adding, for example, sodium alginate, to promote dispersion. The carbon fiber dispersion is then added (optionally) to the tobacco-fiber slurry together with (optionally) conventional flavors. Any other hydrocolloid, may be added in lieu of the sodium alginate as long as it preferably does not interfere with the flavored tobacco response, is water soluble and has a suitable molecular weight to impart strength to the tobacco web 66. The resultant mixture is then wet-laid onto a fourdrinier wire of a conventional paper-making machine or the like (such as a steel belt) to form a base web 68. The solubles previously removed by washing the tobacco strip are mixed with ground tobacco, and the mixture is coated onto one side of the base web, preferably with a standard reverse roll coater located after a drum or Yankee dryer beyond the fourdrinier wire. The ratio of tobacco solubles to tobacco dust or particulates in the added slurry is preferably set at a value between about 1:1 and 20:1, but preferably at or about 4 to 1. The added slurry may also be cast or extruded onto the base web 68. Alternatively, the coating step may be executed off-line separate from the production of the base web 68. During or after the coating step, flavors that are conventional in the cigarette industry are preferably added. Pectin or other hydrocolloids are added, preferably in a range of between 0.1 to 2.0% by weight of the tobacco web 66, to improve the coatability of the slurry.

The present invention may be practiced with other types of base webs 68 (carriers), including the carbon fiber or metallic or screen mats described in copending, commonly assigned U.S. patent applications Ser. No. 07/943,504 (PM 1550); Ser. No. 07/943,747 (PM 1655); and Ser. No. 08/118,665 (PM 1697), all of which are incorporated herein by reference by their entireties.

Whichever type of base web 68 or carrier is used, the tobacco flavor material 70 is preferably disposed on the inner surface of the base web 68 and liberates flavors when heated. Such materials include continuous sheets, foams, gels, dried slurries or dried spray-deposited slurries, which preferably, although not necessarily, contain tobacco or tobacco-derived materials, and which are more fully discussed in the above-incorporated, commonly assigned U.S. patent application Ser. No. 07/943,747 (PM 1655).

Preferably, a humectant, such as glycerin or propylene glycol, is mixed in the tobacco flavor slurry and added on-line to the tobacco web 68 in amounts of about 0.5% to 10% humectant by the weight of the web, more preferably at or about 3% to 9% by the weight of the web. The humectant acts as an aerosol precursor and facilitates formation of a visible aerosol during smoking of the cigarette 23. Additionally, as the humectant is released to and condenses in the atmosphere, the condensed humectant provides an appearance typically expected of cigarette smoke.

The cigarette 23 preferably has an essentially constant diameter along its length and, which like more traditional cigarettes, is preferably between approximately 7.5 mm and 8.5 mm in diameter so that the smoking system 21 provides a smoker a familiar "mouth feel". In the preferred embodiment, the cigarette 23 is 58 mm in overall length, thereby facilitating the use of conventional packaging machines in the packaging of the cigarettes 23. The combined length of the mouthpiece filter 98 and the free-flow filter 96 is preferably 30 mm. The tipping paper preferably extends approximately 7 mm past the end of the free-flow filter 96 over the tobacco rod 60. The length of the tobacco rod 60 is preferably 28 mm. The tobacco web 66 is supported at its opposite ends by the fluted bell 84 and the smooth bell 78 of the double-belled plug 75, where the bells 78 and 84 are each in substantial surface-to-surface contact with the tobacco web 66 for approximately 5 mm along their lengths, respectively, and are fixed with glue lines. Preferably, the space 92 between the tobacco web 66 and the belled plug 75 preferably extends approximately 14 mm in length.

One or more glue lines 116 are provided along the outer periphery of the fluted bell 84 to affix the belled plug 75 to one end of the tobacco web 66. Similar lines of glue are also preferably applied to the outer peripheral portions of the smooth bell 78 to affix it to the other end of the tobacco web 66.

Referring now to FIGS. 3*a* and 4, the double-belled plug 75 of the preferred embodiment includes preferably four discrete flutes 91 equally spaced about the fluted bell portion 84, with each having a depth sufficient to communicate the space 92 within the tobacco rod 60 with the space 100 of the tipping 62. The double-belled plug 75 is preferably constructed from plasticized tow which after blooming is extruded in accordance with practices known in the art to form continuous filter plug rods. These rods are then crimped to form the stem portion 90 and the flutes 91 on a continuous basis in a manner described below. Plasticized tow is preferred in that it readily forms smooth surfaces along the stem 90 and the belled plug portions 78 and 84, including the flutes 91. Smoothness along the surfaces of the double-belled plug 75 helps minimize condensation of tobacco aerosol as the aerosol is drawn from the tobacco rod 60. The stem 90 is constructed as narrow as practical, preferably to a dimension one-third to one-quarter of the outside diameter of the double-belled plug 75. The smaller diameter at the stem 90 provides greater space 92 between stem 90 and the tobacco wrap 66, which extra space minimizes impaction of aerosol as it is driven off the tobacco flavor material 70.

Rough surfaces along the plug 75 present condensation sites to the aerosol generated from the tobacco web 66 upon activation of a heater 37. It is within the practice of the present invention to roughen surfaces of the stem 90 and/or regions of the fluted bell 84 in order to achieve a desired amount of impaction and condensation of aerosol, if desired.

The depth, length and shape of flutes 91 can be configured to adjust pressure drops through the flutes 91 so as to adjust resistance to draw of the cigarette 23 and to manipulate the proportional content of the solid phase verses the gas phase content of the aerosol as it passes from the space 92 of the tobacco rod 60 into the space 100 of the tipping 62. Preferably, the length of the channels defined by the flutes 91 are made as short as possible to minimize pressure drop and to minimize filtration, impaction and presentation of condensation sites. It is to be realized that any aerosol that passes through the body of the fluted bell 84 undergoes filtration which will remove solid phase content from the aerosol. It is preferred to minimize such filtration by directing most or all of the flow of aerosol through the flutes 91 so as to maximize tobacco taste in the smoke.

In particular, each flute 91 presents an inlet portion 110 for admitting at least some of the aerosol into a flute 91 and an outlet portion 112 from which the aerosol leaves the flute 91 to enter the tipping 62. It is to be realized that the outlet portion 112 is partially defined by the inner radius of the free flow filter 96 (whose arc is represented by the dashed lines 114 in FIG. 3A), because the body of the free-flow filter 96 partially overlaps the radially outer portions of the fluted bell 84 in the preferred embodiment. If the outlet portion 112 is constricted, a pressure drop will occur across the flutes 91, which will elevate resistance to draw. However, the constriction may dissipate the aerosol. Additionally, a constriction at the flutes 91 may accelerate interaction between a gas-phase content and a solid-phase content of an aerosol so as to alter (usually reduce with greater constriction) the proportional content of gas phase within the final aerosol leaving the cigarette 23.

Figure 3B:
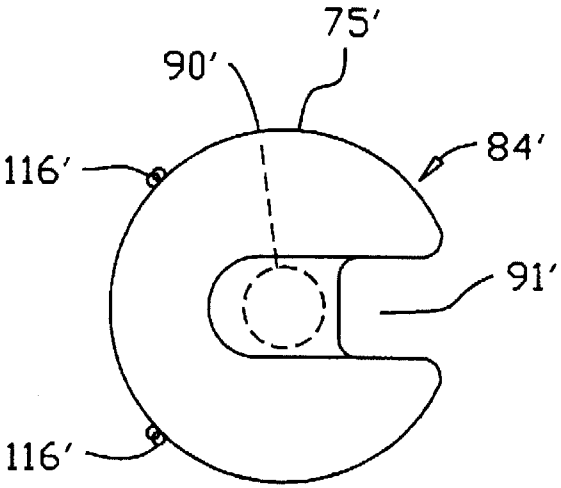
FIG. 3*b* is an end view of alternate fluted end of the double-belled plug.

Referring now to FIG. 3*b*, in another preferred embodiment of the present invention the fluted bell 84' includes a single flute 91', preferably with an outlet portion 112' greater in area than the inlet portion 110' thereof. This embodiment has an additional advantage of substantial uninterrupted surface for contacting surrounding portions of the tobacco web 66. Such arrangement facilitates placement of glue lines 116' at the outer perimeter of the fluted bell 84'.

Figure 3C:
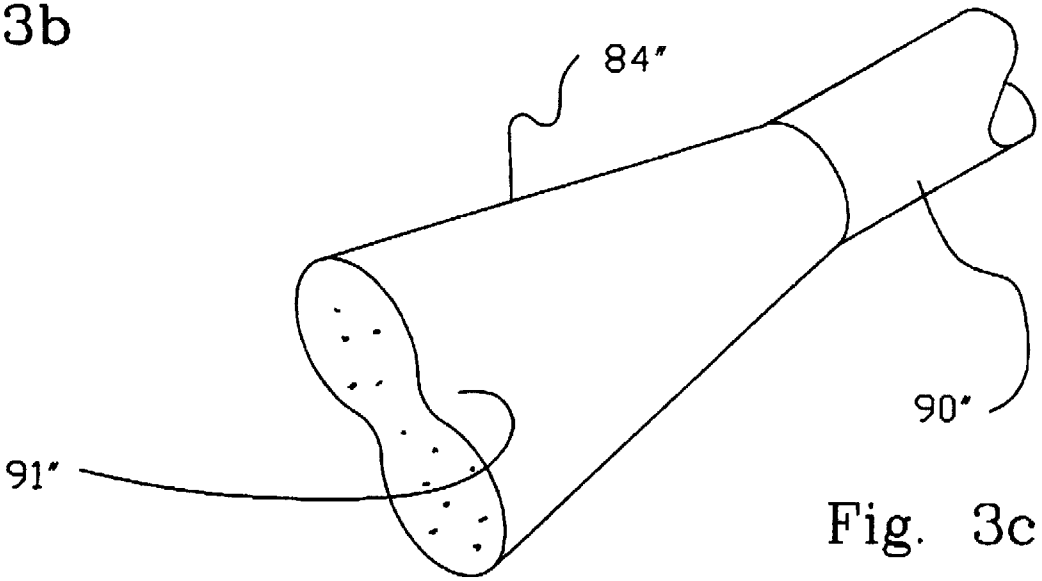
FIG. 3*c* is a detail perspective view of another alternate fluted end of the double-belled plug in the most preferred form.

Although the preferred and alternate embodiments disclosed above include four flutes and one flute, respectively, the present invention contemplates provision for any number of flutes 91 or other similar arrangements for assuring the passage of aerosol from within the tobacco rod 60 into the tipping 62. In reference to FIG. 3*c*, it has been found to be even more preferable to resort to a pair of flutes 91" in a fluted bell 84".

Figure 5:
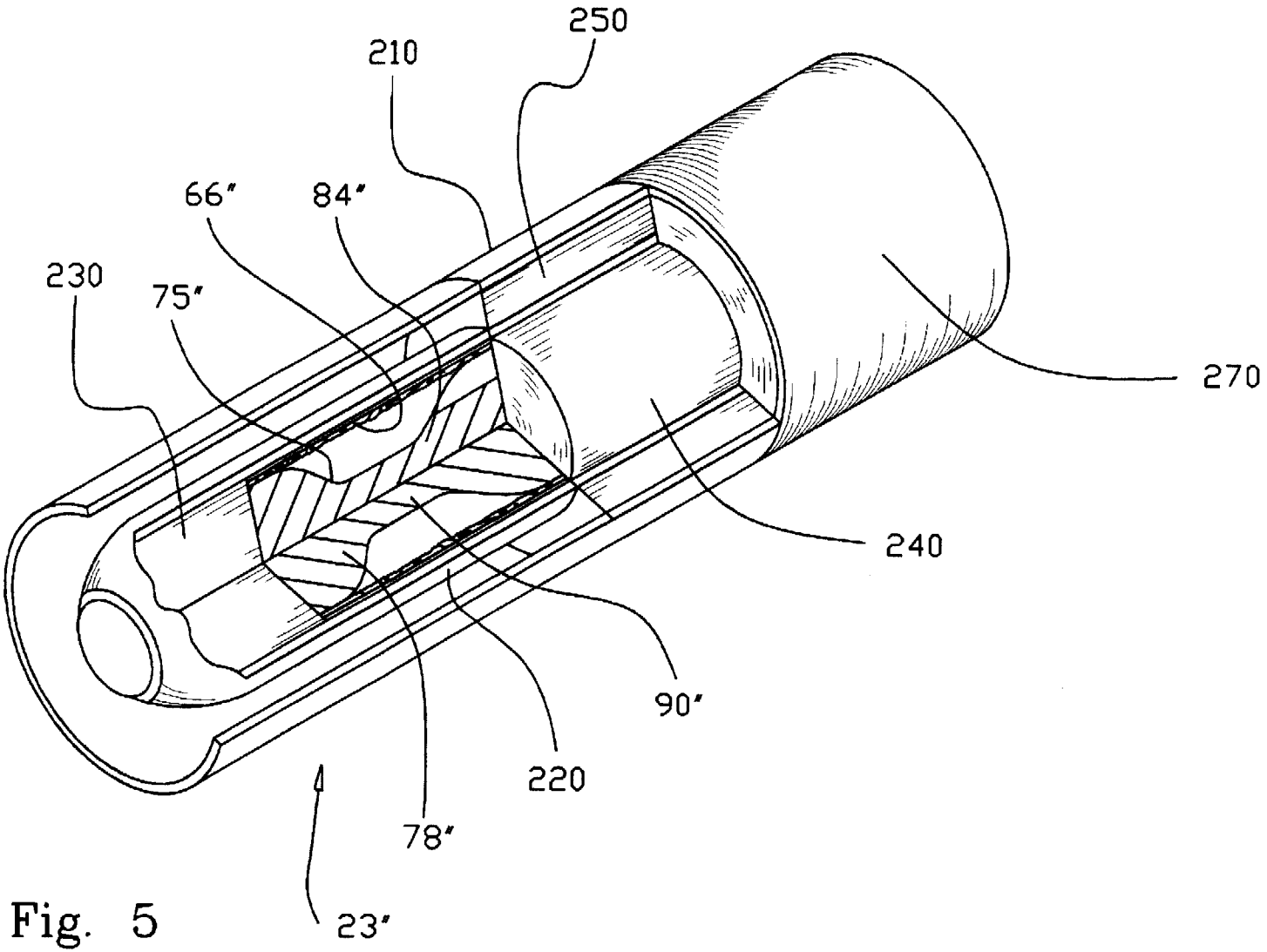
FIG. 5 is a partial sectional, perspective view of a cigarette in accordance with another embodiment of the present invention.

Referring now to FIG. 5, yet another embodiment of the present invention includes a modification of the cigarette disclosed in commonly assigned, co-pending U.S. patent application Ser. No. 07/943,504 (PM 1550). This embodiment comprises an outer tube 210 and inner tube 220 concentrically disposed therein. One end of the inner tube 220 is preferably capped with a tapered filter 230 and the opposite end includes a low efficiency filter plug 240. Between the plugs 230 and 240 is disposed a double-belled plug 75 having a smooth belled portion 78" adjacent the tapered filter 230 and a fluted bell portion 84" adjacent the low efficiency filter plug 240. The inner tube 220 is spaced apart from the outer tube 210 by an annular plug 250. An aerosol generating tobacco material is provided along the inner surfaces of the inner tube 220 adjacent the stem 90" of the plug 75". A tipping paper 270 is applied about the mouthpiece end of the cigarette 23". The inner tube 220 is preferably constructed from a tobacco web 66" like those of the other embodiments.

Figure 6:
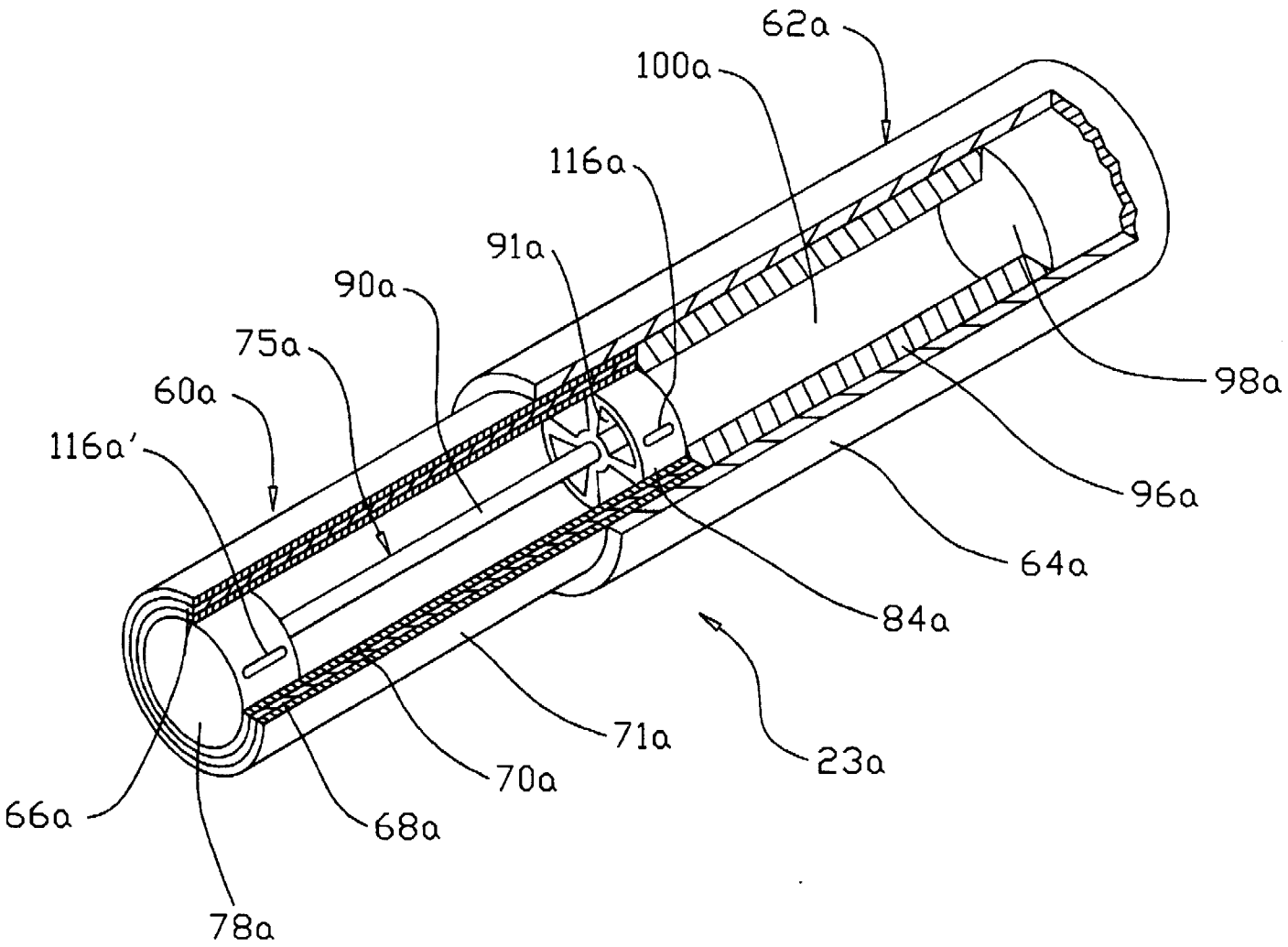
FIG. 6 is a break-away, perspective view of a cigarette in accordance with a third embodiment of the present invention.

Referring to FIG. 6, another preferred embodiment resorts to the construction of a double-belled plug **75*a* constructed from a molded piece of plastic or composite of cellulose fibers and appropriate adhesive. Generally, the cigarette 23*a* of FIG. 6 includes components of similar functionality as those with corresponding designations in FIG. 2, realizing of course that in the alternate embodiment cigarette 23*a*, the plug 75*a* is not necessarily in the form of a bell, but instead may comprise cylindrical portions 78*a* and 84*a*, wherein cylindrical portion 84*a* includes passages 91*a* which function comparably to the flutes 91 in FIG. 2. Advantageously, the stem 90*a* of the alternate embodiment in FIG. 6 may be constructed as narrow as desired and the outer peripheries of cylindrical portions 78*a* and 84*a* are conducive to receiving glue lines 116*a* and 116*a*'. It is to be realized that a plastic plug 75*a* could be constructed with open ended passages 91*a*** such that the passages more resemble the geometry shown for the embodiment in FIG. 3*a*.

Referring back to FIG. 1*b*, when the cigarette 23 of the preferred embodiment of FIG. 2*a* is fully inserted in the receptacle of the lighter 25, its free end 82 abuts or nearly abuts an inner bottom surface at the base of the heater fixture 39, and the tobacco rod 60 is slidingly received by the heating elements 37. In this position, substantially all of tipping 62 of the cigarette 23 including the second free-flow filter 96 and the mouthpiece filter 98 preferably remains outside of the receptacle 27. Portions of the heater elements 37 are preferably biased radially inwardly to facilitate holding the cigarette 23 in position relative to the lighter 25 and to assure that they are in good thermal transfer relationship with the tobacco rod 60.

Figure 1C:
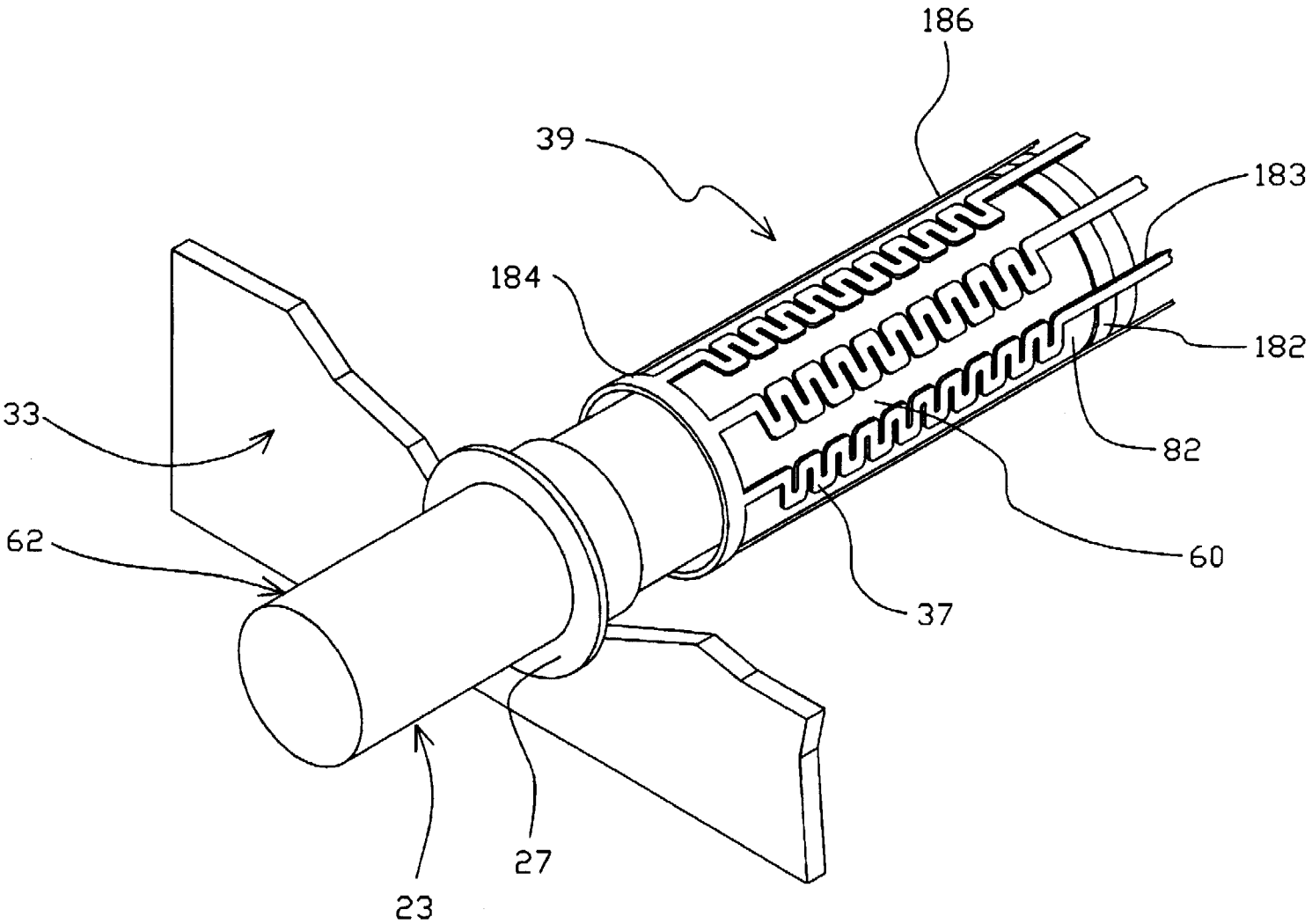
FIG. 1*c* is a breakaway view of a cigarette engaged within the heater fixture of the smoking system shown in FIG. 1*a;*

Referring to FIG. 1*c* in conjunction with the teachings incorporated by reference from commonly assigned, copending U.S. Ser. No. 08/118,665 (PM 1697), when a cigarette 23 of the preferred embodiment is inserted into receptacle 27, it is guided into the heating fixture 39 such that the tobacco rod 60 of the cigarette 23 slidingly engages the individual heater elements 37 until the free end 82 of the cigarette 23 abuts a stop 182 fixedly arranged at the base of the heater fixture 39. Once the cigarette is in place, smoking may commence, where upon any puffing action on the cigarette by the smoker is detected by the puff sensor 45, which in cooperation with the control circuit 41 causes electric current to be delivered to a preselected one of the heaters 37. Power is delivered via an electrical circuit which includes leads 183 at one end of each heater 37, a common ring 184 at the opposite end of each heater 37 and a common lead 186 extending from the common ring 184 back to the proximity of the leads 183. As each heater 37 is activated, thermal energy is transferred through the overwrap 71 and the tobacco web 66 in sufficient amount to cause the tobacco flavor material 70 of the tobacco web 66 to release a tobacco aerosol into space 92 of the tobacco rod 60 and out through the tipping 62 to the smoker. Referring particularly to FIG. 1*b*, each firing of the heaters 37 creates a charred zone 42. Usually a smoker will not remove the cigarette until all heaters are fired in which case these charred zones 42 will comprise a series of equally spaced apart chars generally at a mid-point location along the tobacco rod 60, with the web structure somewhat weakened at each of those charred zones 42. Accordingly, at the end of the smoking, the cigarette 23 is weakened at locations where it lies adjacent the heaters 37, which is problematic in that the cigarette 23 is slidingly withdrawn past the heaters 37 upon its removal. The double-belled plug 75 provides an additional structural connection between the tipped end 88 of the tobacco rod 60 and the free end 82 so that withdrawal can be complete and without breakage of the tobacco rod 60. With the added structural reinforcement provided by double-belled plug 75, the tobacco web 66 and overwrap 71 may be constructed from thinner materials, because they no longer must solely bear the task of keeping the free end 82 attached to the rest of the cigarette 23 during withdrawal of the cigarette 23 from the heater fixture 39. This advantage in turn means that the thermal transfer from the heaters 37 to adjacent portions of the tobacco flavor material 70 can be more immediate and more complete than with a thicker overwrap 71 and/or a thicker tobacco web 68. The cigarette 23 constructed in accordance with the present invention is also less prone to crushing at its free end 82 during insertion into the lighter 25 and is sufficiently rigorous to withstand general handling by the consumer and to withstand high speed mechanical handling in modern cigarette making and packing machines.

Air flow through the cigarette 23 may be accomplished in many ways, but preferably the overwrap paper and the tobacco web 66 are sufficiently air permeable to obtain a desired RTD such that, when a smoker draws on the cigarette, air passes transversely or radially through the overwrap paper 71 and the tobacco web 66 into the space 92. In the alternative or in addition, the smooth bell 78 of the belled plug may be perforated longitudinally or otherwise made air permeable to admit a desired proportion of air into space 92 in an axial (longitudinal) direction (along the axis of symmetry). With the first puff, the axially admitted flow may comprise a greater proportion of the total airflow until the charring of the tobacco rod 60 creates breaks therein, whereupon radially admitted airflow preferably dominates.

If desired, transverse air flow into the space 92 is facilitated by providing a series of radial perforations (not shown) through both the overwrap paper 71 and the tobacco web 66 in one or more regions adjacent the space 92. Such perforations have been observed to improve the tobacco flavor response and aerosol formation. In the preferred embodiment, the tobacco web 66 is perforated at approximately 1 hole per 1 to 2 square millimeters, with a hole diameter of between 0.4 mm and 0.7 mm so as to achieve a preferred CORESTA permeability of between 100–500, but more preferably about 300 to 400. Alternatively, the tobacco web alone can be perforated to a Coresta of approximately 200–700, or the outerwrap alone can be perforated to a Coresta of approximately 500–2500. Of course, in order to achieve desired smoking characteristics, such as resistance to draw, one may use perforation densities and associated hole diameters other than those described above.

In reference to the preferred embodiment of FIG. 2 and in reference to FIG. 7, the preferred embodiment of the present invention may be manufactured in accordance with a process which includes supplying tow material to a filter rod forming device 310, and subsequently passing the formed filter rod through a die forming station 320, where a plurality of die wheels 32 press the continuous filter plug rod material 312 to form a continuous, die-formed rod 324. The die-formed rod includes a plurality of stems 90, between which are interposed doubled-up, smooth bells 78 and doubled-up, fluted bells 84. Downstream of the die forming station 320, the continuous rod 324 enters a wrapping station 340, where a supply of tobacco web 66 and a supply of overwrap paper 71 are brought into proximity with the die-formed continuous rod 324 and folded thereabout at a garniture 342 to form a continuous tobacco rod 344. A first glue applicator 346 applies one or more glue lines continuously along one side of the tobacco web 66 as it is brought into position adjacent the die-formed continuous rod 324. The spacing and pattern applied by the first glue applicator 346 is configured such to assure bonding of the double-belled plug 75 to the tobacco web 66 upon completion of the wrapping operation, both at the smooth bell 78 and at the fluted bell 84 of the plug 75. Preferably the glue pattern of the glue applicator 346 is interrupted and synchronized with the die-formed rod so that little or no glue is applied along that portion of the tobacco web 66 which will align itself adjacent the stem 90 of the die formed continuous rods 324. Such arrangement minimizes the presence of adhesive in the region where the tobacco rods 60 will be heated so as to minimize the possibility of the adhesive contributing an off-taste during smoking.

A second applicator 348 applies one or more glue lines along one side of the overwrap 71 facing the tobacco web 66 so as to assure bonding of the overwrap 71 with the tobacco web 66. The applicator 348 preferably applies a glue line along a edge portion of the overwrap 71 for purposes of completing the seam formed along the continuous tobacco rod 344. In order to minimize possible off-taste from the presence of adhesives in the final product, the applicator 348 applies adhesive only along the edge portion along the overwrap 71 that forms a seam in the continuous rod 344, but manufacturing and quality control may be facilitated by the addition of one or more additional glue lines along the overwrap paper 71.

Figure 7:
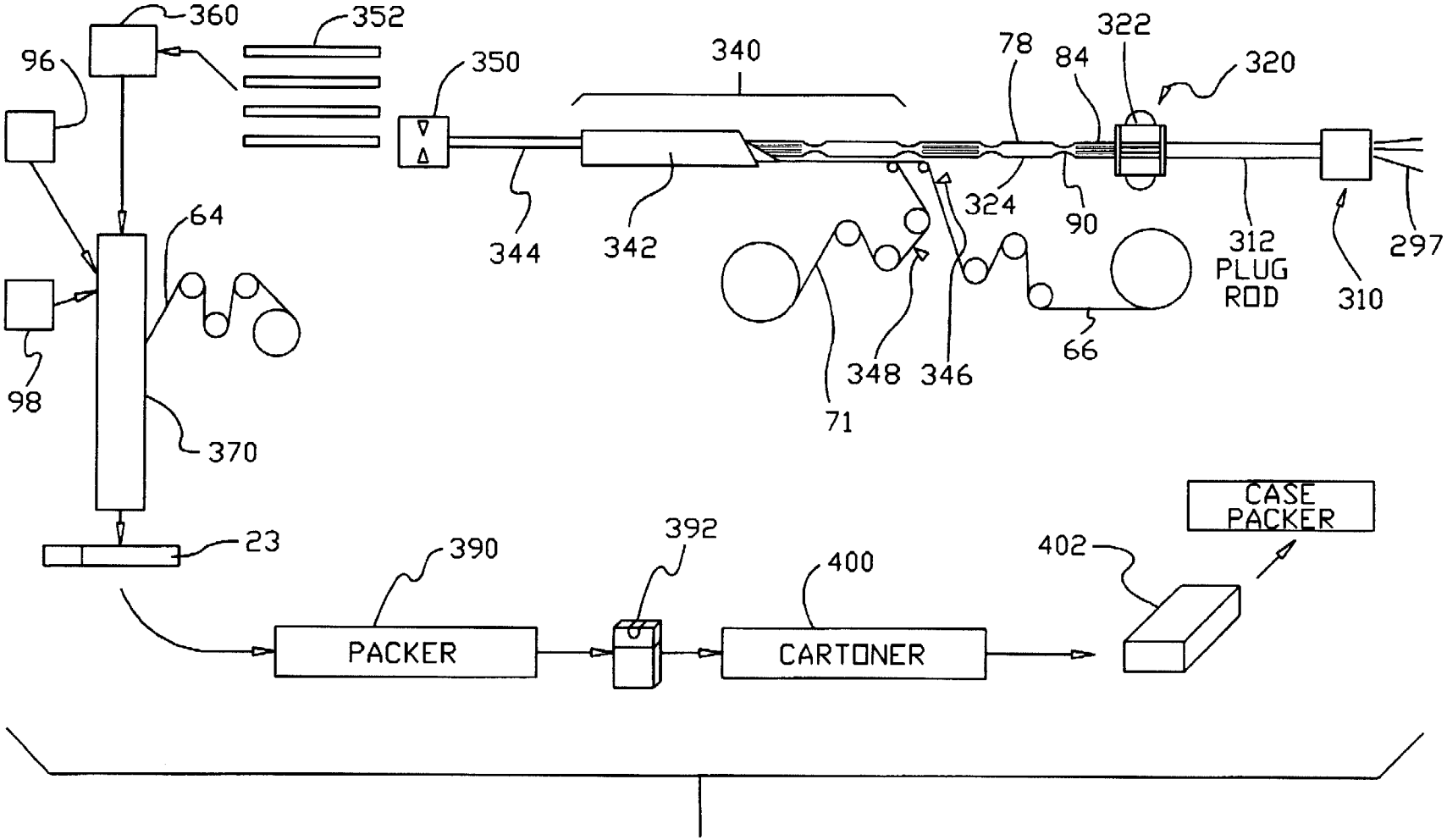
FIG. 7 is a schematic of a manufacturing arrangement and process for producing and packaging cigarettes in accordance with a preferred embodiment of the present invention.
Figure 8:
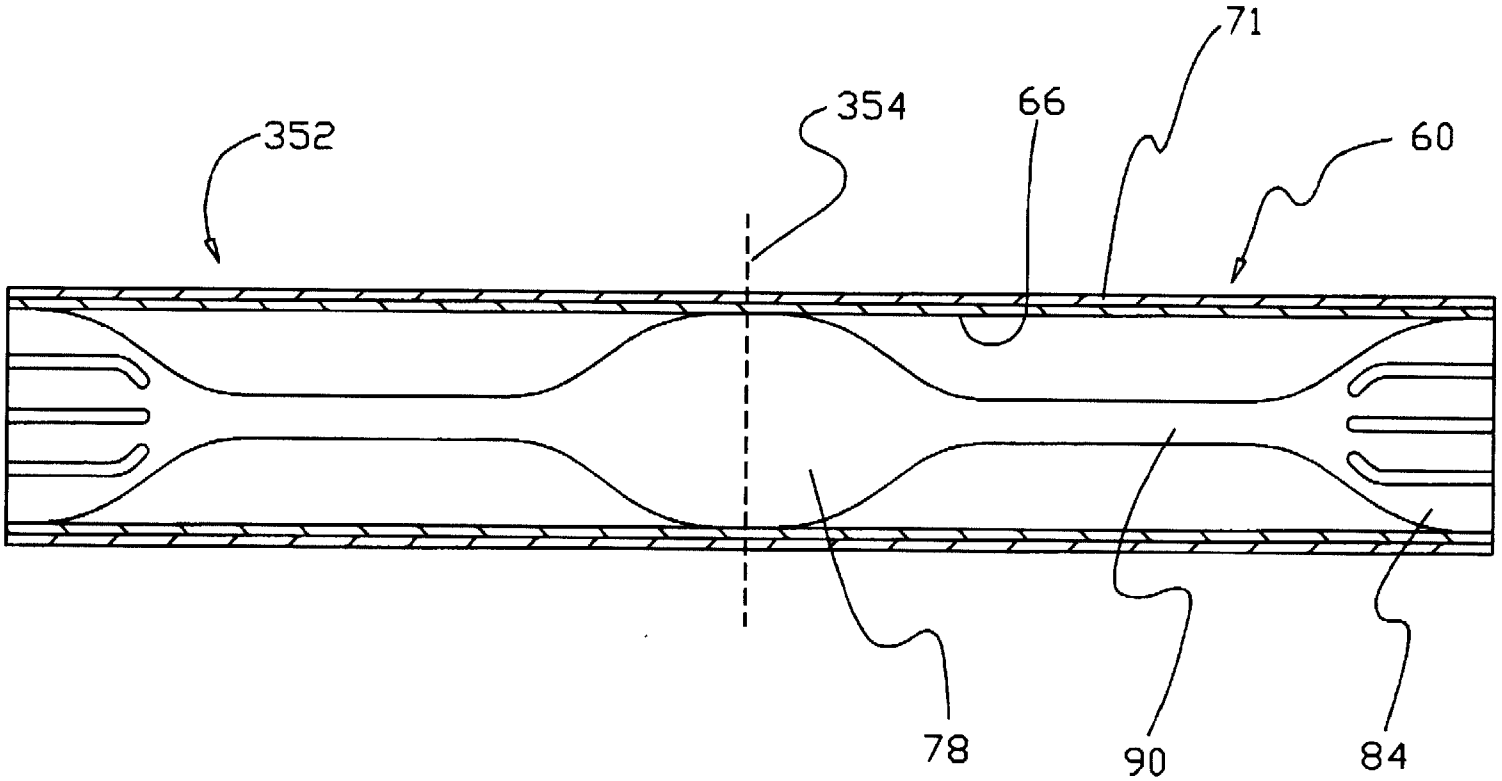
FIG. 8 is a partial sectional view of a sliced tobacco rod produced in accordance with the preferred method illustrated in FIG. 7.
Figure 9:
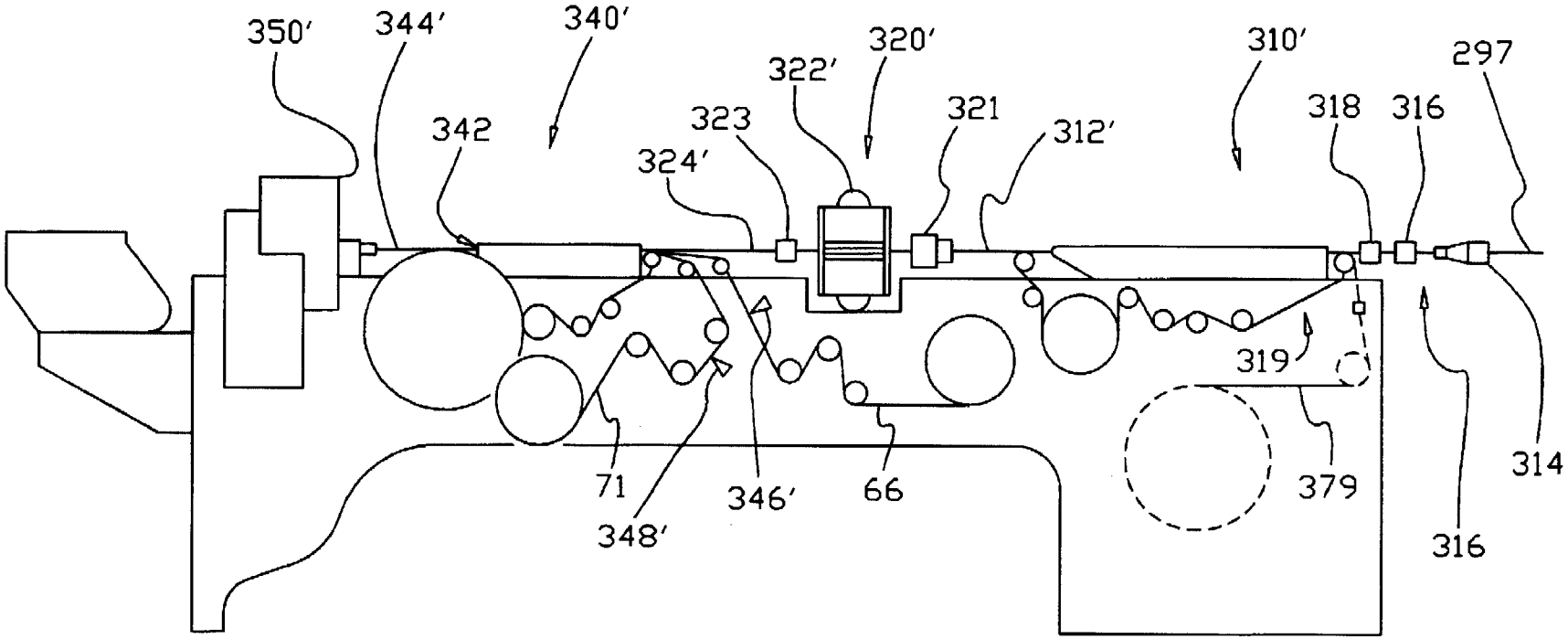
FIG. 9 is a detail of a preferred rod forming device, die forming station, and wrapping station useful in the practice of the preferred method illustrated in FIG. 7.

Referring to FIGS. 7 and 8, upon its leaving the wrapping station 340, the continuous tobacco rod 344 is cut at a cutter station 350, preferably into "two-up" rods 352, which if cut at the imaginary line 354 in FIG. 8 would render a pair of complete tobacco rods 60. It is within the practice of this invention to have the cutter station 350 cut "four-up" rods 352', which may be separated in similar fashion to form four complete tobacco rods 60. In either case or any other arrangement of cutting the rods 352, the cut rods 352 are then slit at a slitter station 360 to form the individual tobacco rods 60. the individual tobacco rods 60 are then tipped at a tipping machine 370 with plugs 96 and 98 and tipping paper 64 to form cigarettes 23 as previously described. The tipping machine 370 has tipping functionalities similar to a Hauni Max-S/80, however one of ordinary skill may readily adjust a standard Max-S/80 or other similar machine to perform this operation. The cigarettes are then collated and packed within a packer 380 to form cigarette packs 392 in a conventional manner. Thereafter the packs 392 are preferably passed through cartoners 400 of standard design to form cartons 402, which in turn are sent through case packers as is common in the trade in the packing of more traditional cigarettes.

Additional details concerning construction of the filter rod forming station 310, the die forming station 320 and the wrapping station 340 can be gleaned from the teachings of U.S. Pat. Nos. 4,784,632; 3,847,064; 3,637,447; and 4,075,936, which patents are all expressly incorporated herein in their entireties by reference. However, referring to FIGS. 9–12, a preferred arrangement and method for producing tobacco rod 60 preferably begins with a continuous filamentary tow 297 that includes a multiplicity of bondable fibrous members which can be activated by contact with a hot fluid such as steam. The tow 297 is continuously passed into and through a conventional stuffer jet 314 and a steam head 316, similar in nature to those shown and described in U.S. Pat. Nos. 3,637,447; 4,046,063; and 4,075,936. Following the steam treatment, the resulting rod is cooled at a cooling head 318 while the rod is pulled along by a garniture arrangement 319, from which exits a plug rod 312. The garniture 319 provides a continuous pulling mechanism which draws the rod through these initial processing stages comprising the rod forming device 310'. Upon leaving the garniture 319, the plug rod 312' is subjected to water and steam treatment at a water head 321 prior to the formation of the flutes 91 and stems 90 in the rod. These features together with the belled portions of the plug 75 are formed by passing the rod 312' between a set of four heated crimper wheels 322', which are more fully described in the description below in relation to FIGS. 10, 11, and 12. After these features are formed in the plug rod 312' to form the die-formed plug rod 324', the rod 324' is passed through a cooling head 323 while it is continuously pulled by a second garniture arrangement 342. As the die-formed plug rod 324' is brought toward the garniture 342', overwrap paper 71 and tobacco web 66 is brought into wrapping relationship with respect to the rod 324', whereupon wrapping and sealing is effected so at to produce a continuous tobacco rod 344' at the exit of the garniture 342.

The rod 344' is severed transversely as described before at selected locations at a cutter 350'.

If desired the process and arrangement described above in reference to FIG. 9 may include the arrangement of first wrapping the plug rod 312' with a heat sealable plastic sheath 379 at the first garniture arrangement 319. Provision for the sheath 379 about the plug rod 312' results in a die formed plug rod having a smooth surface, particularly when the tow material is highly friable.

Figure 12:
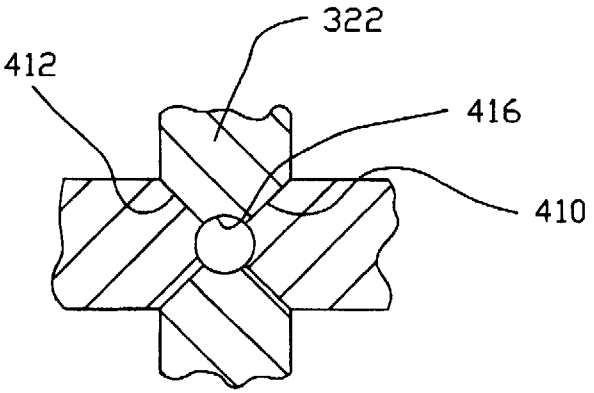
FIG. 12 is a fragmentary sectional view of the die forming wheels in FIGS. 7 and 11 as configured for producing double-belled plugs in accordance with the preferred embodiment shown in FIG. 3*a;*
Figure 11:
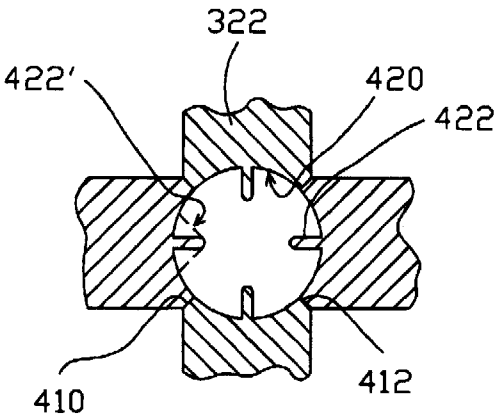
FIG. 11 is a fragmentary sectional view of the die forming wheels in FIGS. 7 and 9, for the formation of fluted bells in accordance with the preferred embodiments.
Figure 10:
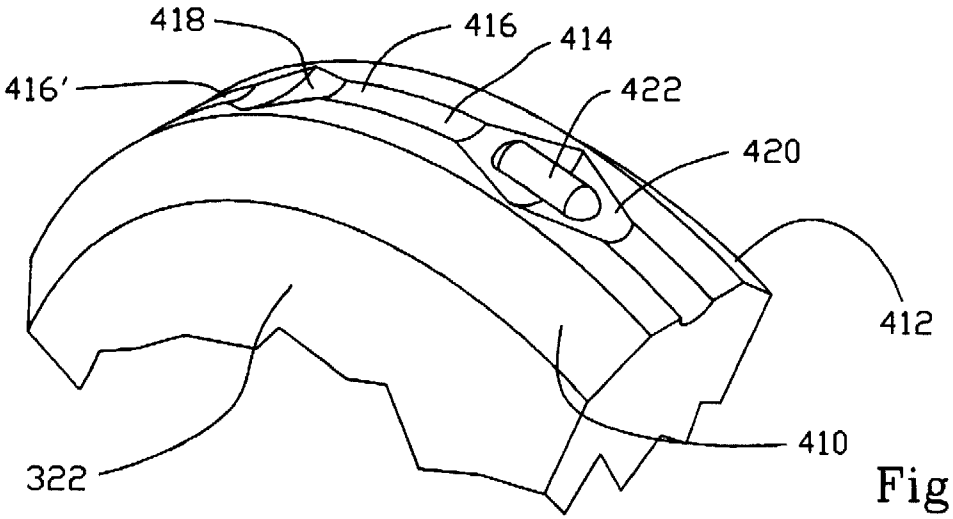
FIG. 10 is a partial perspective view of a rim of a die forming wheel of FIGS. 7 and 9.

Referring particularly to FIGS. 10–12, each heated die wheel 322 (and 322') include rim surfaces 410 and 412 which mesh with like surfaces on the rims of the adjacent ones of heater wheels 322. Between the rim surfaces 410 and 412 lie molding surfaces 414, which include grooves 416 and 416' , et seq., which are configured to form the stem portions 90 at spaced-apart locations along the die-formed rod 324. The molding surfaces 412 also include surfaces 418 configured to form the smooth bells 78 in the die-formed plug rod 324 and surfaces 420 configured to form the fluted bells 84 in the die-formed plug rod 324. The surfaces 418 which form the smooth bells 78 and the surfaces 420 which form the fluted bells 84 alternate in relation to one another as one progresses along the rim of a heater wheel 322.

With particular reference to FIG. 11, the surfaces 420 for forming the fluted bells 84 include projections 422 which are configured to press into the plug rod 312 to form of the flute passages 91. These projections may be readily modified to provide flutes 91 of almost any desired shape and number such as, for example, a more triangular trough-shaped flute 91 as would be formed if the projections 422 were rendered more triangular in cross-sectional form as indicated by the dashed lines 422' in FIG. 11.

Figure 13:
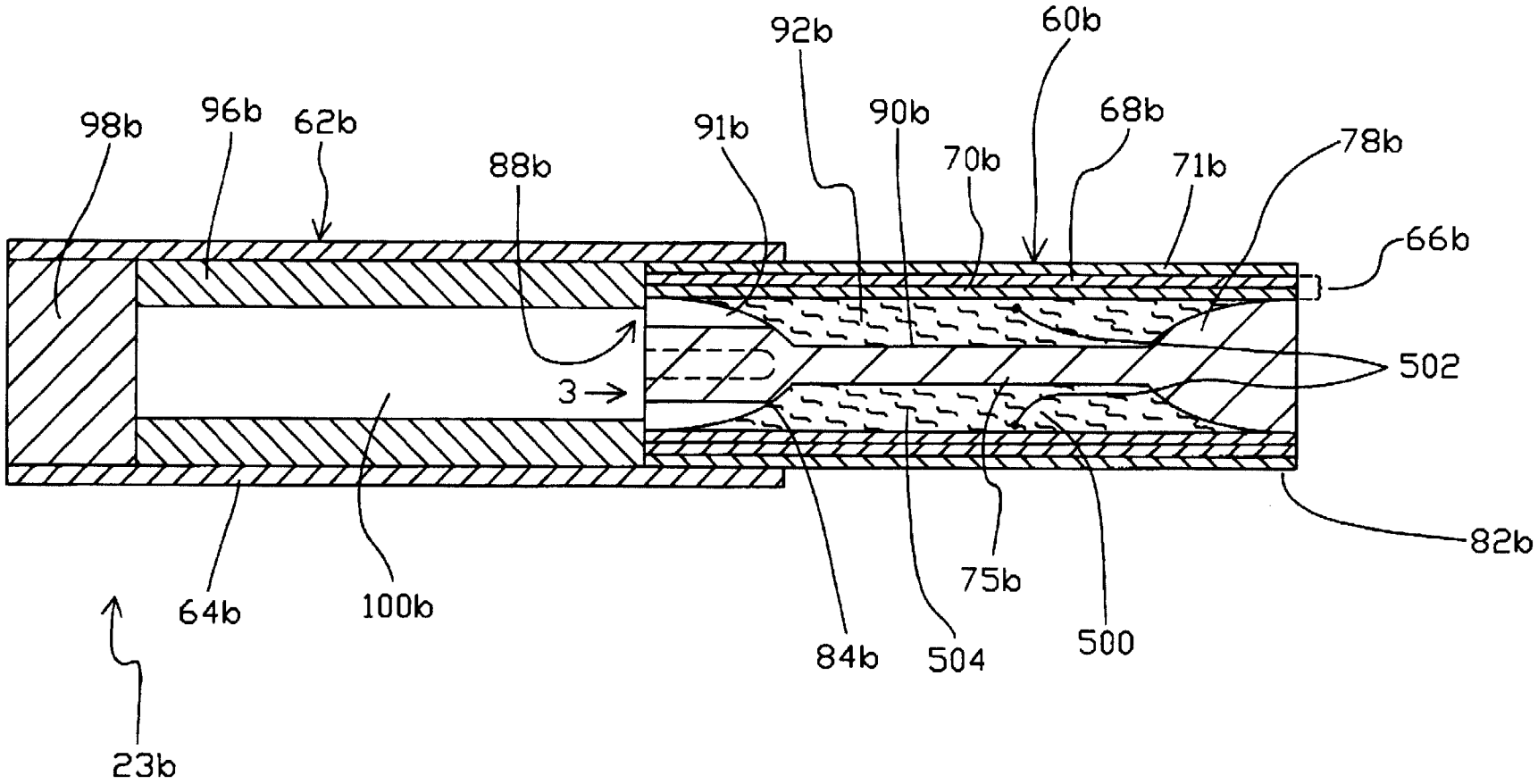
FIG. 13 is cross-sectional view of a cigarette constructed in accordance with a first alternate preferred embodiment of the present invention.

Referring to FIG. 13, a cigarette 23 constructed in accordance with an alternate embodiment includes a tobacco rod **60*b* and a tipping 62*b* having the same construction of the tobacco rod 60 and the tipping 62 of the preferred embodiment described above in reference to FIG. 2. However, the alternate cigarette 23*b* includes cut filler 500 in the space 92*b* between stem 90*b* of the double-belled plug 75*b* and the tobacco web 66*b***. The cut filler preferably comprises a blend of tobaccos typical of the industry, including blends comprising flue-cured, burley and oriental tobaccos together with, optionally, reconstituted tobacco and other blend components, including flavorings.

The cut filler 500 contributes a more uniform firmness to the cigarette **23*b*, particularly in the regions along the tobacco rod 60*b* between the belled portions 78*b* and 84*b* of the plug 75*b*. The cut filler 500 also contributes longitudinal strength of the tobacco rod 60*b* by providing additional mechanical linkage between the tipped end 88*b* and the free end 82*b* of the tobacco rod 60*b*. The linkage is mostly due to the inter-tangled condition of the tobacco strands 504 along the length of the rod 60, which strands remain substantially intact even after a smoking of the cigarette 23*b***.

Additionally, the cut filler 500 contributes tobacco flavor to the aerosol as the latter is drawn off the tobacco web 66 and drawn out the tobacco rod 606 through the cut filler 500. Furthermore, peripheral portions 502 of the cut filler 500 adjacent the tobacco web 66 undergo sufficient local treating during the activation of a heating element 37, so that it, too, generates at least some additional aerosol. Optionally, the cut filler also serves as a carrier for conventional cigarette flavors.

Figure 14:
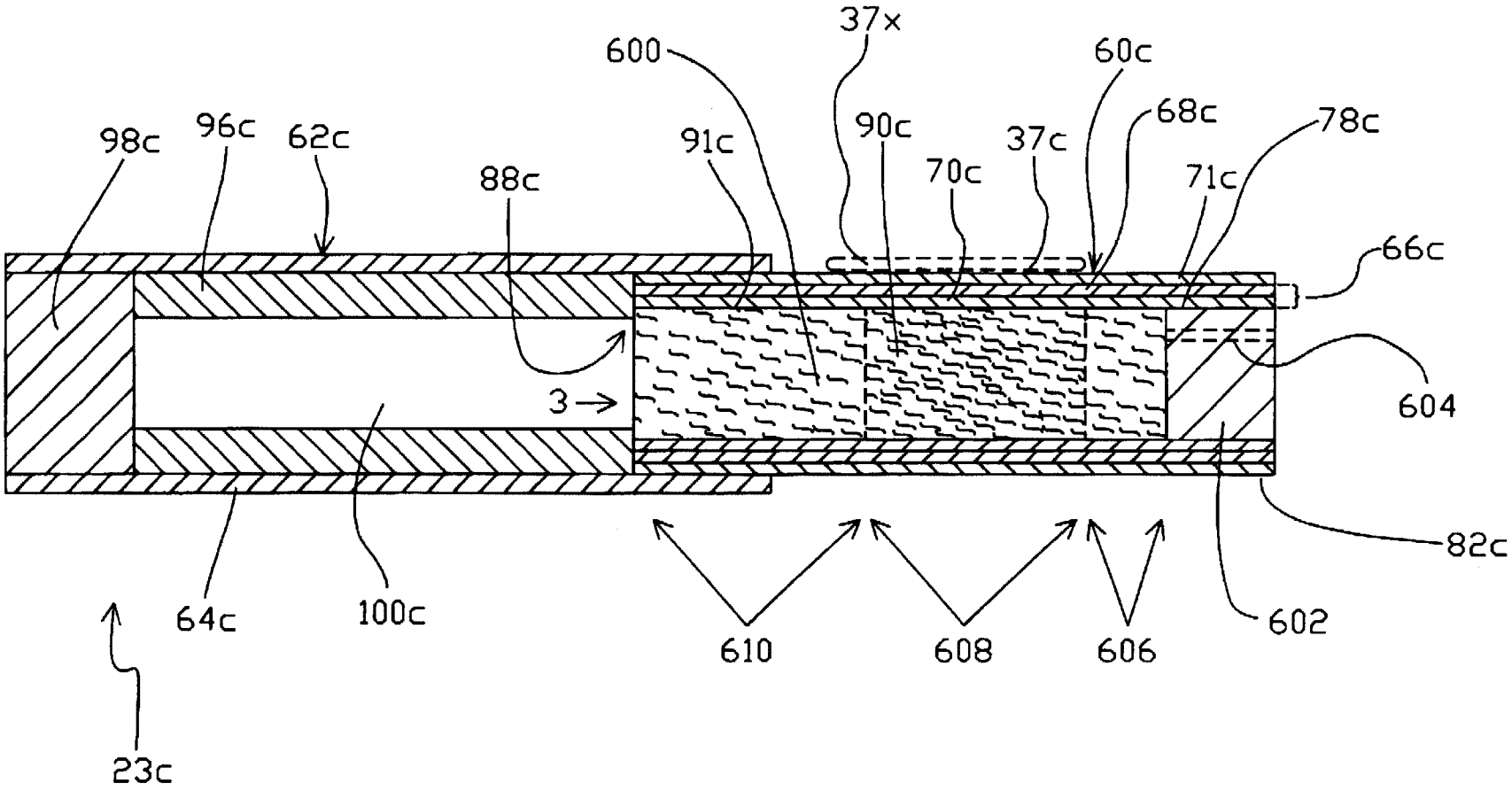
FIG. 14 is a cross-sectional view of a cigarette constructed in accordance with a second alternate preferred embodiment of the present invention.

Referring now to FIG. 14, another alternate embodiment provides a cigarette **23*c* having a tipping 62*c*, a tobacco web 66*c* and a wrapper 71*c* constructed and arranged in the same manner as described in cigarette 23 with reference to FIG. 2. However, in the present alternate embodiment, the tobacco web 66*c* of the cigarette 23*c* encloses a column of cut filler 600 along a substantial portion of the length of the tobacco rod 60*c*. A backflow filter plug 602 of moderate to low efficiency, preferably about 15 to 25 percent efficiency, is provided at the free end 82*c* of the tobacco rod 60*c*. The backflow filter 602 is preferably constructed from conventional filter materials such as cellulose acetate. The backflow filter 602 is configured to limit and/or preclude admission of air longitudinally into the cigarette 23*c*. Optionally, the backflow filter 602 may be provided with one or more channels or pin-holes 604 to admit a predetermined amount of airflow. The backflow filter 602 also discourages smokers for lighting the cigarette 23 in the more traditional manner with a flame from a match (or the like) by giving a clear indication that the cigarette 23*c* is not to be lighted at the free 82*c***.

Preferably, the tobacco column 600 extends from the backflow filter 602 to the tipped end 88c of the tobacco rod **60*c* and includes a first low-density, longitudinal segment 606 adjacent the backflow filter 602, a high density segment 608 at an intermediate location along the tobacco rod 60*c* and a second low density segment (portion) 610 extending from the high density segment 608 to the free end 88*c***.

Preferably, the density of the cut filler comprising the low density segment 606 is about 0.18 to 0.20, whereas that of the high density segment 608 is about 0.23 to 0.26. The density of the second low density segment 610 (near the tipped end 88c) is preferably about the same as that of the first low density segment 606, or more preferably even lower (about 0.16 to 0.20, for the segment second segment 610, most preferably).

The tobacco column 600 comprises blended cut filler comprisings flue-cured, oriental and burley tobaccos, including flavoring.

The tobacco column 600 is formed into the tobacco rod 60c using techniques known in the art of cigarette rod making, such as those taught in commonly assigned, copending Ser. No. 08/259,718 filed Jun. 14, 1994 (PM/FTR 041). In that application a cigarette manufacturing machine is provided with a cam compression device which periodically compress the freshly formed tobacco rod so as to establish spaced regions along the tobacco rod that have a density greater than interim portions of the rod.

The tobacco column 600 is wrapped intimately with the tobacco web 66c, and the cut filler that comprises the column 600 has the form of a continuous, inter-tangled mass of tobacco shreds. Accordingly, the tobacco column 600 provides additional structural connection between the free end 82c of the tobacco rod 60c and its tipped end 88c. Because the tobacco column remains essentially uncombusted throughout its entire length during the smoking of the cigarette 23c, the tobacco column 600 remains at the conclusion of a smoke to contribute to the retention of the free end portion 82c of the cigarette as the cigarette 23c is withdrawn from the lighter 25.

The location and length of the high density segment 608 within the cigarette 23c are selected such that upon insertion of a cigarette 23c, the operative portions of heating elements 37 (being represented in FIG. 14 as 37c in dashed lines) locate about the high density segment 608, preferably with at least an end portion 37x of the heating elements 37 extending longitudinally beyond the high density segment 608 to at least partially overlap the second low density segment 610. With such an arrangement, the high density region 608 mechanically react to (biases against) the radially inwardly directed bias of the heating elements 37 to assure a close, thermally transmissive communication between the tobacco web 66c and the heaters 37 without crushing the cigarette 23c. The portion 37x of the heating elements 37 which overlaps the second low density segment 610 of the tobacco rod 60c generates an aerosol which undergoes less filtration than the aerosol produced by the remainder of the heating element 37. Accordingly, delivery (impact) of the smoking system 21 is enhanced by the provision of the overlapping heater portion 37x. The amount of overlap by the heater portion 37x can be adjusted to adjust delivery of the smoking system.

During a smoke, each activated heating element 37c heats the tobacco web 66c sufficiently to drive tobacco aerosol off the tobacco web 66c, with some additional aerosol being contributed by the tobacco in proximity to the activated heating element 37c. However, because the smoking operation of the present invention does not result in a sustained combustion along the tobacco column 600, the tobacco column 600 remains substantially intact at the end of the smoke so that the tobacco rod 60c may be withdrawn completely without breakages and/or tobacco shreds being left behind in the lighter 25.

Figure 15:
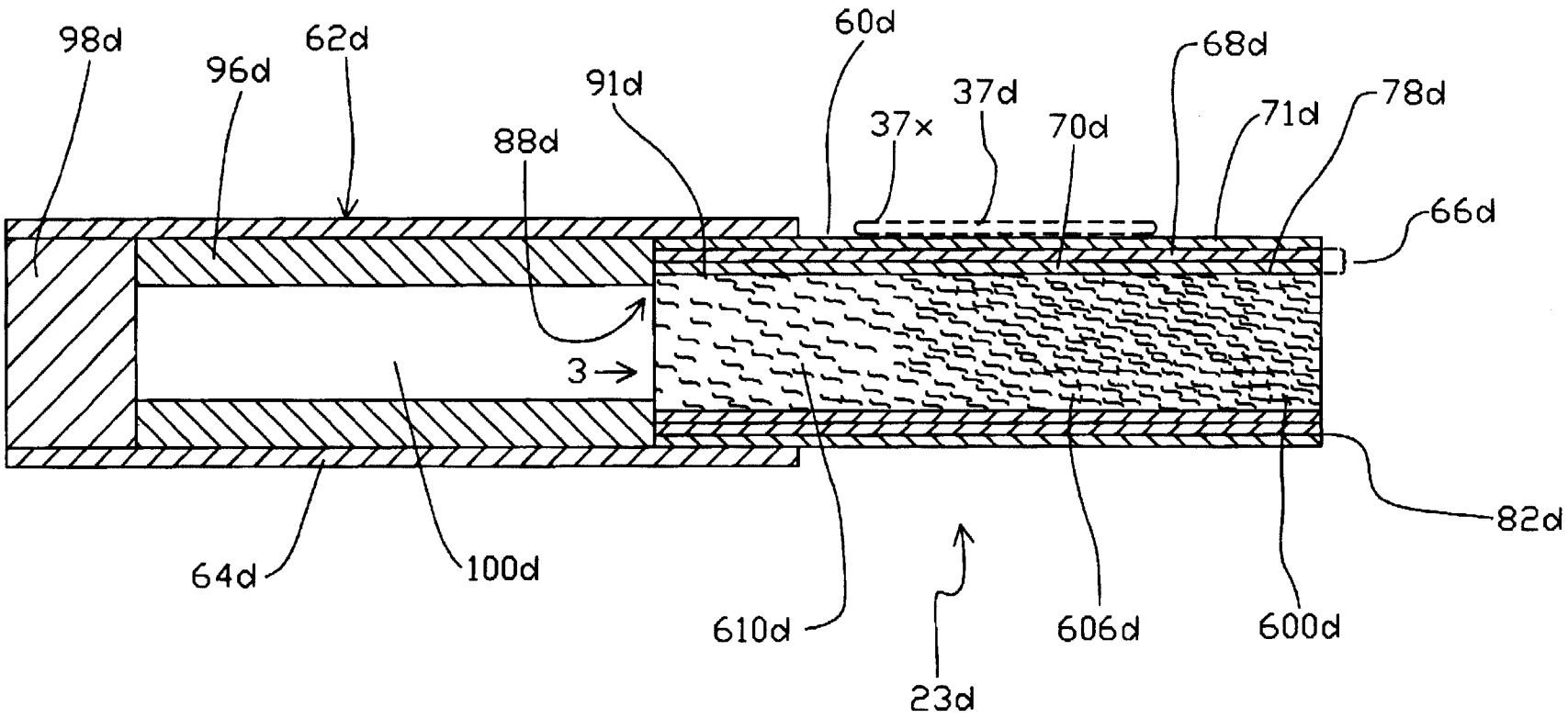
FIG. 15 is a cross-sectional view of a cigarette constructed in accordance with a third alternate preferred embodiment of the present invention.

Referring now to FIG. 15, yet another embodiment of the present invention comprises a cigarette 23d having a tipping 62d and a tobacco rod 60d constructed in like fashion to the tipping 62c and the tobacco rod 60c of the cigarette 23c as described above in reference to FIG. 14. However, the cigarette 23d preferably lacks a backflow filter 602 and its tobacco column 600d includes a longer high density segment 606d and only one low density segment 610d. In this embodiment, the high density segment 606d extends from an intermediate location along the tobacco rod 60d to the free end 82d thereof, and the low density segment 610d extends from the intermediate location toward the tipped end 88d of the tobacco rod 60d.

The high density segment 600d of the cigarette 23d functions the same way as does the counterpart of the cigarette 23c, but additionally, controls "loose ends" (loose strands of tobacco) at the free end 82d of the tobacco rod 60d.

The cigarette 23d is configured so that upon insertion into a lighter 25, a portion 37x of each heating element 37d may extend at least partially over the low density segment 610d. A further advantage of the cigarette 23d is that the high density segment 606d is longer, and therefore may receive an even longer heating element 37d.

Figure 16:
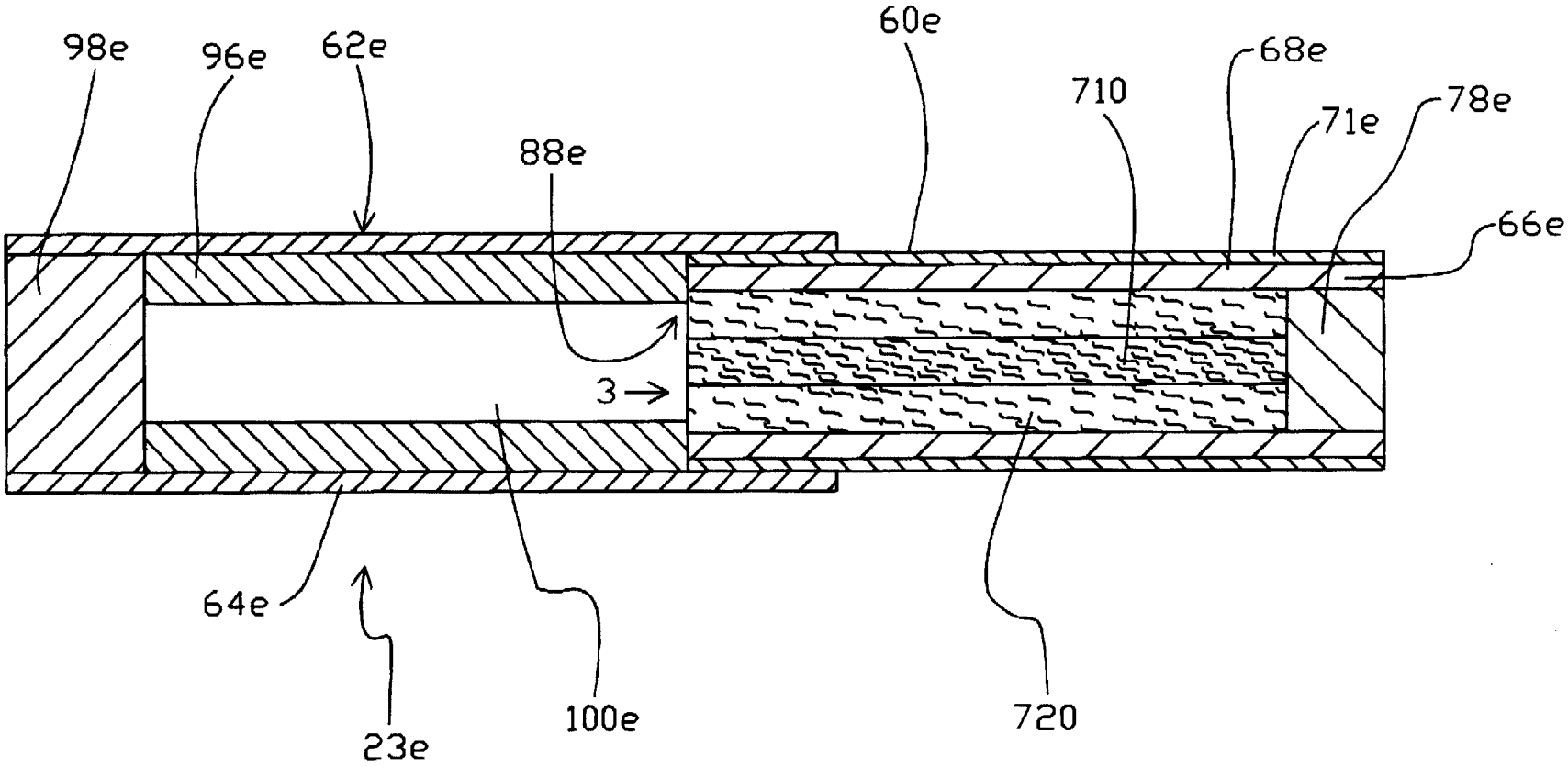
FIG. 16 is a cross-sectional view of a cigarette constructed in accordance with a fourth alternate preferred embodiment of the present invention.

Referring now to FIG. 16, a still another embodiment of the present invention comprises cigarette 23e having a tipping 62e and a tobacco rod 60e constructed in like manner to the tipping 62d and the rod 60d of the cigarette 23d as described above in reference to FIG. 15. However, the tobacco rod 60e of the cigarette 23e comprises a backflow filter 602e, a tobacco mat 66e, overwrap 71e and a tobacco column 600e. In this embodiment, the tobacco column 600e comprises a high density core 710 which is surrounded concentrically by a low density column 720. The diameter of the high density core 710 is arranged to be less than the inside diameter of the free flow filter 96e so that the space occupied by the low density column 720 communicates with the space 100e enclosed within the free flow filter 96e.

When the cigarette 23e is inserted into a lighter 25 and smoked, aerosol generated from the tobacco web 66e evolves into the low density tobacco column 720 and passes predominantly therethrough on its way toward the tipping 62e. As with the other embodiments, portions of the low density tobacco column 720 situated adjacent and activated heating element 37 will contribute some aerosol. Additionally, tobacco flavoring is gained as the aerosol passes through the remainder of the low density tobacco column 720. A smaller proportion of the aerosol passes through the high density tobacco core 710 and accordingly, filtration is minimized.

When smoking of the cigarette 23e is complete, the high density core 710, together with the low density column 720 assure structural connection beyond the charred zones about the periphery of the tobacco rod 60e.

Whereas the cigarette 23e is described as having a central high density tobacco core 710, it is contemplated that the high density core 710 might comprise another reinforcing material such as a central column of cellulose acetate tow or a plastic ribbon or the like, which provides a connection between the tipped end 88e of the tobacco rod 60e with its free end 82e.

Figure 17:
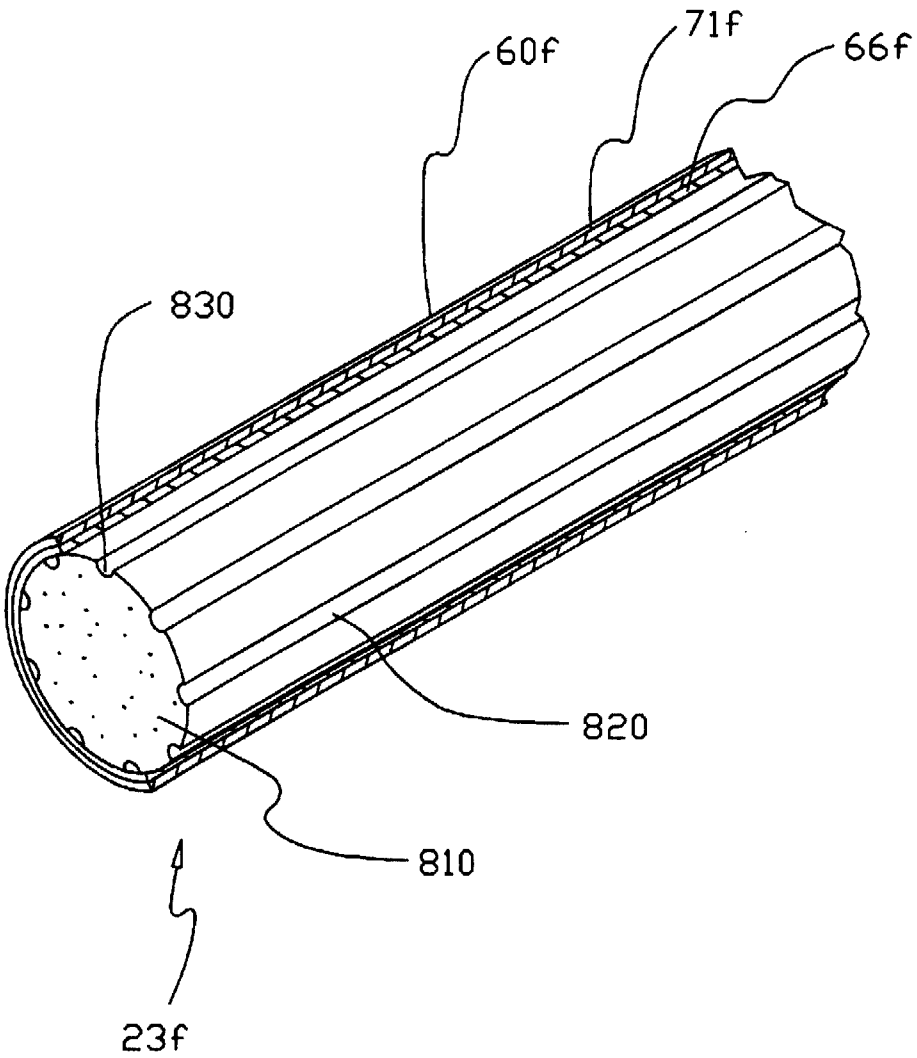
FIG. 17 is a cutaway, perspective view of a tobacco rod portion of a fifth preferred embodiment of the present invention.

Referring to FIG. 17, another embodiment of the present invention comprises a cigarette 23f comprising a tipping 62f constructed like the tipping 62 of any of the other embodiments, but which has a tobacco rod 60f constructed from a filter plug of conventional filter materials (tow) which extends the entire length of the tobacco rod 62f. The filter plug 810 includes a plurality of spaced apart flutes 820 extending along the entire length thereof, and the filter plug 810 is wrapped with a tobacco web 66*f* constructed like the tobacco webs 66 of the other embodiments. Optionally a backflow filter 602*f* is provided at the free end 82*f* to limit and/or prevent entry of air at the ends 830 of the filter plug 810.

When a cigarette 23*f* is inserted into a lighter 25 and puffed, a heating element 37 will cause the tobacco web 66*f* to evolve aerosol which is drawn towards the tipping 62*f* along the flutes 820 and to some extend through the body of the filter plug 810. At the completion of a smoking, the filter plug 810 ensures structural connection between the tipped end 88*f* and the free end 82*f* so that remnants are not left behind in the lighter 25.

Many modifications, substitutions and improvements may be apparent to the skilled artisan without departing from the spirit and scope of the present invention as described and defined herein and in the following claims.

We claim:

1. A cigarette comprising a tobacco rod, said tobacco rod comprising a tubular tobacco web and a plug disposed within said tubular tobacco web, said tobacco rod having a free end and an opposite end, said tubular tobacco web comprising a base web and a layer of tobacco material disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette.

2. The cigarette as claimed in claim 1, wherein said plug includes a stem portion concentrically disposed within said tubular tobacco web, said stem portion being radially spaced from said tubular tobacco web along said intermediate location.

3. The cigarette as claimed in claim 2, wherein said plug includes a first portion which extends across said free end.

4. The cigarette as claimed in claim 3, wherein said plug includes a second portion which extends across said opposite end, said second portion including a passage, said passage configured to facilitate withdrawal of aerosol released from said tubular tobacco web through said opposite end.

5. The cigarette as claimed in claim 1, wherein said plug passage at said opposite end communicates with a space enclosed by said tobacco web.

6. The cigarette as claimed in claim 5, wherein the space enclosed by said tobacco web is filled with cut tobacco.

7. The cigarette as claimed in claim 5, wherein said plug is constructed from a plasticized tow material.

8. The cigarette as claimed in claim 7, wherein said plug includes belled plug portions adjacent said free end and said opposite end.

9. The cigarette as claimed in claim 5, wherein said plug is constructed from a molded material.

10. The cigarette as claimed in claim 9, wherein said tobacco rod further comprises an overwrap about said tubular tobacco web.

11. The cigarette as claimed in claim 9, wherein said plug includes cylindrical end portions connected by a stem portion, said cylindrical portions in substantial surface-to-surface contact with said tobacco web at locations adjacent said free end and said opposite end.

12. The cigarette as claimed in claim 5, wherein said tobacco rod further comprises an overwrap about the tubular tobacco web.

13. The cigarette as claimed in claim 12, further comprising filter tipping at said opposite end.

14. The cigarette as claimed in claim 13, wherein said tipping comprises a free flow filter adjacent said opposite end, said cigarette further comprising tipping paper attaching said free flow filter to said opposite end.

15. The cigarette as claimed in claim 14, wherein said tipping further comprising a mouthpiece filter plug adjacent said free flow filter.

16. The cigarette as claimed in claim 1, wherein said plug comprises a core column of cut filler tobacco of higher density, said core column surrounded by a second column of tobacco of lesser density.

17. The cigarette as claimed in claim 16, wherein said tobacco rod further comprises an overwrap about said tubular tobacco web.

18. The cigarette as claimed in claim 17 further comprising filter tipping at said opposite end.

19. The cigarette as claimed in claim 18, wherein said tipping comprises a free flow filter adjacent said opposite end, a mouthpiece filter adjacent said free flow filter and tipping paper attaching said free flow filter and said mouthpiece filter to said tobacco rod.

20. The cigarette as claimed in claim 18, wherein said plug further comprises a backflow filter at said free end.

21. The cigarette as claimed in claim 1, wherein said comprises a column of cut filler tobacco;

said tobacco column including first and second segments, said first segment having a density greater than said second segment, said first segment at an intermediate location along said tobacco rod;

wherein said second segment extends to said opposite end and said first segment extends to said free end.

22. The cigarette as claimed in claim 21 further comprising filter tipping at said opposite end, said tipping comprising a free flow filter adjacent said opposite end, a mouthpiece filter adjacent said free flow filter and tipping paper attaching said free flow filter and said mouthpiece filter to said tobacco rod.

23. The cigarette as claimed in claim 1, wherein said plug comprises a fluted filter rod, said tubular tobacco web wrapped about said fluted filter rod.

24. A cigarette comprising a tobacco rod, said tobacco rod comprising a tubular tobacco web and a plug disposed within said tubular tobacco web, said tobacco rod having a free end and an opposite end, said tubular tobacco web comprising a base web and a layer of tobacco material disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette;

said plug including a stem portion concentrically disposed within said tubular tobacco web;

said plug including a first portion which extends across said free end;

said plug including a second portion which extends across said opposite end, said second portion including a passage, said passage configured to facilitate withdrawal of aerosol released from said tubular tobacco web through said opposite end;

said plug passage at said opposite end communicating with a space enclosed by said tobacco web;

said plug including belled plug portions adjacent said free end and said opposite end; and wherein said passage is defined by a flute in said belled portion adjacent said opposite end.

25. The cigarette as claimed in claim 24, wherein said plug is constructed from a plasticized tow material.

26. The cigarette as claimed in claim 24, wherein the space enclosed by said tobacco web is filled with cut tobacco.

27. A cigarette comprising a tobacco rod, said tobacco rod comprising a tubular tobacco web and a plug disposed within said tubular tobacco web, said tobacco rod having a free end and an opposite end, said tubular tobacco web comprising a base web and a layer of tobacco material disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette;

said plug including a stem portion concentrically disposed within said tubular tobacco web;

said plug including a first portion which extends across said free end;

said plug including a second portion which extends across said opposite end, said second portion including a passage, said passage configured to facilitate withdrawal of aerosol released from said tubular tobacco web through said opposite end;

said plug passage at said opposite end communicating with a space enclosed by said tobacco web;

said tobacco rod further comprising an overwrap about the tubular tobacco web;

said cigarette further comprising filter tipping at said opposite end; and wherein said passage through said plug portion adjacent said opposite end communicates the space within said tubular tobacco web with a space defined within said free flow filter.

28. A cigarette comprising a tobacco rod, said tobacco rod comprising a tubular tobacco web and a plug disposed within said tubular tobacco web, said tobacco rod having a free end and an opposite end, said tubular tobacco web comprising a base web and a layer of tobacco disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette;

said plug including a stem portion concentrically disposed within said tubular tobacco web;

said plug including a first portion which extends across said free end;

said plug including a second portion which extends across said opposite end, said second portion including a passage, said passage configured to facilitate withdrawal of aerosol released from said tubular tobacco web through said opposite end;

said plug passage at said opposite end communicating with a space enclosed by said tobacco web; said plug being constructed from a molded material; and said plug including cylindrical end portions connected by a stem portion, said cylindrical portions in substantial surface-to-surface contact with said tobacco web at locations adjacent said free end and said opposite end; said cigarette further comprising filter tipping at said opposite end.

29. The cigarette as claimed in claim 28, wherein said tipping comprises a free flow filter adjacent said opposite end, said cigarette further comprising tipping paper attaching said free flow filter with said opposite end.

30. The cigarette as claimed in claim 29, wherein said tipping further comprising a mouthpiece filter plug adjacent said free flow filter.

31. The cigarette as claimed in claim 30, wherein said passage through said plug portion adjacent said opposite end communicates a space enclosed by said tobacco web with a space defined within said free flow filter.

32. A cigarette comprising a tobacco rod, said tobacco rod comprising a tubular tobacco web and a plug disposed within said tubular tobacco web, said tobacco rod having a free end and an opposite end, said tubular to tubular tobacco web comprising a base web and a layer of tobacco material disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette;

wherein said plug comprises a column of cut filler tobacco;

wherein said plug further comprises a backflow filter at said free end, said cigarette further comprising filter tipping at said opposite end.

33. The cigarette as claimed in claim 32, wherein said tobacco rod further comprises an overwrap about the said tubular tobacco web.

34. The cigarette as claimed in claim 32, wherein said tobacco column includes first and second segments, said first segment having a density greater than said second segment, said first segment at an intermediate location along said tobacco rod.

35. The cigarette as claimed in claim 32, wherein said column of cut filler comprises lower density tobacco and higher density tobacco, said higher density tobacco concentrically disposed along said tobacco column.

36. A cigarette comprising a tobacco rod, said tobacco rod comprising a tubular tobacco web and a plug disposed within said tubular tobacco web, said tobacco rod having a free end and an opposite end, said tubular tobacco web comprising a base web and a layer of tobacco material disposed along an inside surface of said base web, said tobacco material including ground tobacco, said base web adapted to transfer heat from an electrical heating element to said tobacco material, said tobacco rod adapted to operatively receive an electrical heating element at an intermediate location between said free end and said opposite end, said plug providing structural connection of said free end with said opposite end, said structural connection of said free end with said opposite end intact after a smoking of said cigarette;

wherein said plug comprises a column of cut filler tobacco;

wherein said tobacco column includes first and second segments, said first segment having a density greater than said second segment, said first segment at an intermediate location along said tobacco rod; and wherein said second segment extends to said free end.

37. A method of producing cigarettes, said cigarette comprising a tubular tobacco web and a plug disposed within said tubular tobacco web, said tubular tobacco web having a free end and a opposite end, said plug structurally connecting said free end with said opposite end, said process comprising the steps of:

(a) producing a continuous plug rod from a supply of fibrous tow material;

(b) passing said continuous plug rod through a die forming station so as to form a die-formed plug rod having narrowed stem portions at spaced locations along said die-formed plug rod, said die forming step further including the step of alternately forming at locations along said die-formed plug rod between said formed stem portions a smooth belled portion and a fluted belled portion;

(c) overwrapping said die formed plug rod with a tobacco web and overwrap, together with the application of an adhesive so as to produce a continuous tobacco rod;

(d) transversely severing said continuous tobacco rod at spaced locations, said spaced locations being intermediate of at least one of said smooth belled portion and said fluted belled portion within said continuous tobacco rod.

38. The method as claimed in claim 37, wherein said method further comprises the step of slitting said plugs so as to produce tobacco rods having a smooth belled portion at a free end thereof and a fluted belled portion at an opposite tipping end thereof and tipping said tobacco rods at said tipping ends with filter plugs and tipping paper, whereby a cigarette comprising a tobacco rod and tipping is produced.

39. The method as claimed in claim 38, wherein said method further comprises packing said cigarette into packs of cigarettes containing a predetermined number of said cigarettes.

40. The method as claimed in claim 39, wherein said method further comprises the step of packing said cigarette packs into a carton comprising a predetermined number of cigarette packs.

41. The method as claimed in claim 40, wherein said method further comprises the step of packing said cartons into cases comprising a predetermined number of cigarette cartons.

* * * * *